US006876339B2

(12) United States Patent
Hiroki

(10) Patent No.: US 6,876,339 B2
(45) Date of Patent: Apr. 5, 2005

(54) SEMICONDUCTOR DEVICE AND DRIVING METHOD THEREOF

(75) Inventor: Masaaki Hiroki, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 130 days.

(21) Appl. No.: 09/740,944

(22) Filed: Dec. 21, 2000

(65) Prior Publication Data

US 2001/0005194 A1 Jun. 28, 2001

(30) Foreign Application Priority Data

Dec. 27, 1999 (JP) ..... 11-371696

(51) Int. Cl.[7] ..... G09G 5/00
(52) U.S. Cl. ..... 345/3.3; 345/3.2; 345/99
(58) Field of Search ..... 345/3.2, 89, 99, 345/127, 690, 132, 100, 98, 204, 694, 667, 611, 88, 3.3; 348/678; 375/240.01; 386/109; 324/121 R

(56) References Cited

U.S. PATENT DOCUMENTS 4,713,688 A * 12/1987 Guttner ..... 375/240.01
5,025,400 A * 6/1991 Cook et al. ..... 345/611

(Continued)

FOREIGN PATENT DOCUMENTS

| | | |
|---|---|---|
| EP | 0 786 867 | 7/1997 |
| JP | 02-135421 | 5/1990 |
| JP | 07-130652 | 5/1995 |
| JP | 08-065609 | 3/1996 |
| JP | 09-149344 | 6/1997 |
| JP | 09-289527 | 11/1997 |
| JP | 10-268842 | 10/1998 |

OTHER PUBLICATIONS

W42C31–09, "Spread Spectrum Frequency Generator", pp. 1–9, Jul. 1998, IC Works.
Application Note 201, "EMI Suppression Techniques with Spread Spectrum Clock Gererator (SSCG) ICs", pp. 1–2, Feb. 1998, IC Works.
Search Report, European Patent Office, 4 pages, Jul. 27, 2000.
Cornelis D. Hoekstra, "Frequency Modulation of System Clocks for EMI Reduction", Hewlett–Packard Journal, Aug. 1997, pp. 101–106.

(Continued)

*Primary Examiner*—Chanh Nguyen
*Assistant Examiner*—Uchendu O. Anyaso
(74) *Attorney, Agent, or Firm*—Eric J. Robinson; Robinson Intellectual Property Law Office, P.C.

(57) ABSTRACT

The object is to realize format conversion in inputting an image signal corresponding to conventional low resolution (hereafter referred to as a video signal) to an active matrix semiconductor display device or to a passive matrix semiconductor display device corresponding to recent high resolution, and at the same time to provide a novel method of driving capable of improving the resolution in an outline portion of an image. With the driving method of the present invention, conversion of a screen size which is not capable of being completely performed by only lowering a clock frequency, can be completely performed by artificially reducing the number of scans of gate signal lines in accordance with outputting a gate selection pulse at a timing for simultaneously selecting a plurality of gate signal lines using a modulated clock signal in which a clock signal has been modulated at a constant period. Simultaneously, by creating shading information in the outline portion in accordance with using a modulated clock in a source signal line driver circuit and a gate signal line driver circuit, the apparent resolution is improved utilizing the Mach phenomenon and the Craik-O'Brien phenomenon.

25 Claims, 22 Drawing Sheets

U.S. PATENT DOCUMENTS 5,115,189 A * 5/1992 Holcomb ..... 324/121 R
5,334,996 A * 8/1994 Tanigaki et al. ..... 345/694
5,359,342 A * 10/1994 Nakai et al. ..... 345/89
5,420,645 A 5/1995 Traa et al.
5,448,259 A * 9/1995 Hidaka ..... 345/99
5,568,163 A * 10/1996 Okumura ..... 345/100
5,600,347 A * 2/1997 Thompson et al. ..... 345/667
5,643,826 A 7/1997 Ohtani et al.
5,703,621 A * 12/1997 Martin et al. ..... 345/690
5,736,893 A 4/1998 Puckette et al.
5,737,033 A * 4/1998 Masuda ..... 348/678
5,757,338 A * 5/1998 Bassetti et al. ..... 345/3.2
5,801,672 A * 9/1998 Masuda et al. ..... 345/98
5,818,412 A * 10/1998 Maekawa ..... 345/100
5,818,413 A * 10/1998 Hayashi et al. ..... 345/100
5,818,870 A 10/1998 Yaguchi
5,821,913 A * 10/1998 Mamiya ..... 345/88
5,883,609 A 3/1999 Asada et al.
5,909,144 A 6/1999 Puckette et al.
5,923,962 A 7/1999 Ohtani et al.
6,046,735 A * 4/2000 Bassetti et al. ..... 345/204
6,088,014 A * 7/2000 Furuhashi et al. ..... 345/132
6,104,863 A * 8/2000 Strolle et al. ..... 386/109
6,115,020 A * 9/2000 Taguchi et al. ..... 345/99
6,147,668 A * 11/2000 Eglit ..... 345/99
6,281,873 B1 * 8/2001 Oakley ..... 345/127

OTHER PUBLICATIONS

Inventor: Masaaki Hiroki, Specification and Drawings for U.S. patent application Ser. No.: 09/382,677, Filed: Aug. 25, 1999, 113 pages, "Display Device and Method of Driving the Same".

Office Action dated Jun. 7, 2004 for U.S. Appl. No. 09/382, 677 filed Aug. 25, 1999.

* cited by examiner

640X480 pixels (4:3)

1280X1024 pixels ( 5:4)

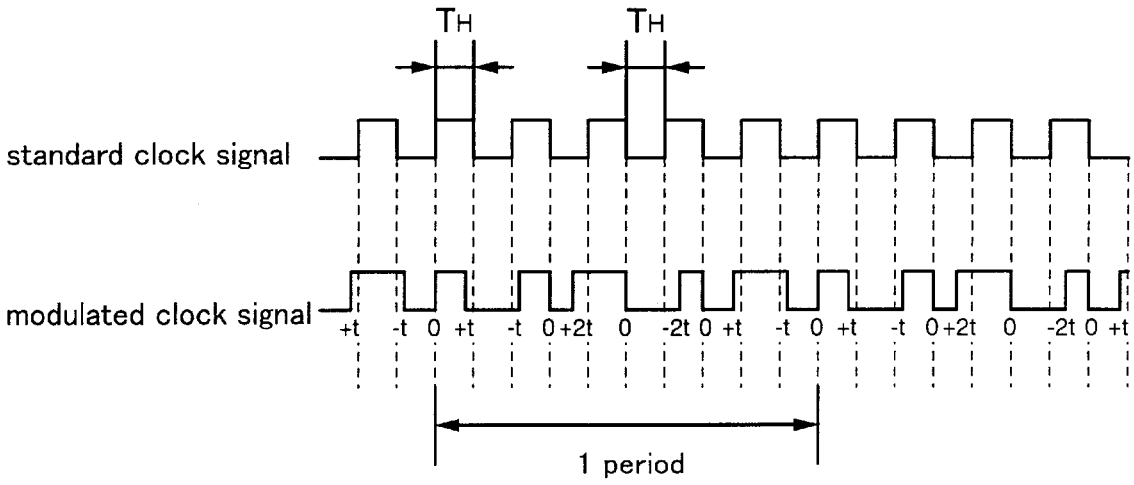
Fig.8A
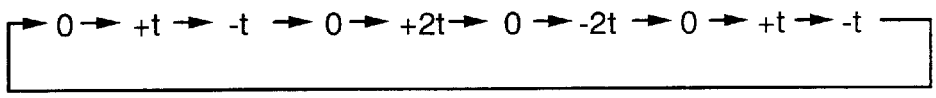
Fig.8B
| displacement | | | | | frequency / 10 |
|---|---|---|---|---|---|
| +2t | * | | | | 1 |
| +t | * | * | | | 2 |
| 0 | * | * | * | * | 4 |
| -t | * | * | | | 2 |
| -2t | * | | | | 1 |
Fig.8C

SEMICONDUCTOR DEVICE AND DRIVING METHOD THEREOF

BACKGROUND OF THE INVENTION

1. Field of the Invention

The present invention relates to a method of driving a display device and to a display device using the driving method. In particular, the present invention relates to a method of driving an active matrix semiconductor display device having a thin film transistor (hereafter referred to as a TFT) manufactured on an insulating surface. Further, the present invention relates to an active matrix semiconductor display device using the driving method, and among active matrix semiconductor display devices, in particular relates to an active matrix liquid crystal display device. Furthermore, the present invention can also be applied to passive matrix semiconductor display devices.

2. Description of the Related Art

Techniques of manufacturing a TFT by forming a semiconductor thin film on a low cost glass substrate have rapidly developed in recent years. The reason for this is that the demand for active matrix semiconductor display devices (liquid crystal panel) has increased.

An active matrix semiconductor display device is a device in which a pixel TFT is placed in each of several hundreds of thousands to several millions of pixels arranged in a matrix state (this circuit is referred to as an active matrix circuit), and in which an electric charge delivered to a pixel electrode in each pixel is controlled by a switching function of the pixel TFT.

A TFT using amorphous silicon formed on a glass substrate is used in a conventional active matrix circuit.

Using a quartz substrate, active matrix semiconductor display devices having a TFT using a polycrystalline silicon film formed on the quartz substrate have recently been realized. Peripheral driver circuit for driving the pixel TFTs can also be manufactured on the same substrate as the active matrix circuit in this case.

Furthermore, techniques of manufacturing a TFT in which a polycrystalline silicon film is formed on a glass substrate by utilizing a technique such as laser annealing are also known. The active matrix circuit and the peripheral circuits can be integrated on the same glass substrate if this technique is utilized.

The active matrix semiconductor display device is often used recently as a display device for a personal computer. Further, large screen size active matrix semiconductor display devices have come to be used not only in notebook type personal computers, but also in desktop type personal computers. Further, projector devices having small size and using a small size active matrix semiconductor display device having high definition, high resolution, high quality have been basking in the spotlight. Among these, high vision projector devices capable of displaying a very high resolution image have been focused upon.

Using an active matrix semiconductor display device or a passive matrix semiconductor display device corresponding to high resolution to display a conventional image signal corresponding to low resolution (hereafter referred to as a video signal), it is necessary to write the video signal into memory one time and then to convert the format, and it is necessary to incorporate memory and circuits for controlling the memory outside of the active matrix semiconductor display device. Furthermore, a video signal corresponding to low resolution which has been converted in format so as to correspond to high resolution has a problem in that dots in an outline portion become easily noticeable because the dots are enlarged.

SUMMARY OF THE INVENTION

In view of the above problems, an object of the present invention is to realize a format conversion for displaying a video signal corresponding to low resolution such as VGA (640×480 pixels) and SVGA (800×600 pixels) in an active matrix semiconductor display device or a passive matrix semiconductor display device corresponding to a high resolution standard such as SXGA (1280×1024 pixels) in accordance with using a novel driving method. Further, an object of the present invention is to realize an increase in image quality of the active matrix semiconductor display device or the passive matrix semiconductor display device using the novel driving method, at the same time as realizing the format conversion for displaying the video signal corresponding to low resolution such as VGA (640×480 pixels) and SVGA (800×600 pixels) in the active matrix semiconductor display device or the passive matrix semiconductor display device corresponding to high resolution standard such as SXGA (1280×1024 pixels).

A modulated clock signal used in the driving method of the present invention is explained first. In contrast to operation in which a standard clock signal has a certain fixed period, the modulation clock signal refers to a clock signal in which the frequency is changed (shifted) in a certain fixed period. Note that the article "Frequency Modulation of System Clocks for EMI Reduction," Hewlett-Packard Journal, August 1997, pp. 101–6, may be referred for details relating to modulation clock signals. However, the main point recorded in the above paper is to reduce the EMI (electromagnetic inference) of a clock signal by using a modulated clock in the field of integrated circuits.

Note that a standard clock signal which becomes a standard can be frequency modulated and any obtained modulated clock signal can also be used in the driving method of the present invention. Therefore, a modulated clock signal in accordance with any method except for the method recorded in the above article or the like can also be used.

In accordance with the present invention, by supplying a modulated clock signal, in which a standard clock is frequency modulated at a constant period, to an active matrix semiconductor display device or to a passive matrix semiconductor display device, when a scanning signal output based on the modulated clock selects a plurality of scanning lines simultaneously over a portion or the entire screen, the number of vertical scans per frame is reduced in practice. In the result, using a video signal corresponding to low resolution such as VGA (640×480 pixels) or SVGA (800×600 pixels), an image can effectively be displayed in an active matrix semiconductor display device corresponding to a high resolution standard such as SXGA (1280×1024 pixels). At the same time, in accordance with shifting the location at which the plurality of scanning lines are simultaneously selected in each fixed frame period by regulating a timing of the clock modulation, and by utilizing a phenomenon by which the resolution can be seen to have increased (the visual Mach phenomenon or the Craik-O'Brien phenomenon) with producing shading information, the apparent vertical resolution is improved and a decrease in image quality accompanying an expanded video signal can be suppressed.

At the same time, by supplying the above modulated clock signal to a driver circuit of an active matrix semiconductor display device or to a driver circuit of a passive matrix semiconductor display device, signal information of the sampling vicinity of a video signal sampled based upon the modulated clock signal (edge existence, closeness) can be written to corresponding pixels of the semiconductor display device as shading information. In accordance with this shading information, the apparent horizontal resolution can be improved by utilizing the Mach phenomenon and the Craik-O'Brien phenomenon.

The method of driving a semiconductor display device of the present invention, and the structure of the semiconductor display device using the driving method, are explained below.

According to a first aspect of the present invention, there is provided a method of driving a semiconductor display device, comprising the steps of:

performing frequency modulation of a first standard clock signal and obtaining a first modulated clock signal;

selecting a gate signal line based upon the first modulated clock signal;

sampling an image signal based on a second standard clock signal; and supplying the sampled image signal to a corresponding pixel and obtaining an image.

According to a second aspect of the present invention, there is provided a method of driving a semiconductor display device, comprising the steps of:

performing frequency modulation of a first standard clock signal and obtaining a first modulated clock signal;

performing frequency modulation of a second standard clock signal and obtaining a second modulated clock signal;

selecting a gate signal line based upon the first modulated clock signal;

sampling an image signal based on the second modulated clock signal; and supplying the sampled image signal to a corresponding pixel and obtaining an image.

According to a third aspect of the present invention, there is provided a method of driving a semiconductor display device, comprising the steps of:

performing frequency modulation of a first standard clock signal and obtaining a first modulated clock signal;

selecting a gate signal line based upon the first modulated clock signal;

sampling an analog image signal based on a second standard clock signal, performing A/D conversion, and obtaining a digital image signal;

performing D/A conversion based on the second standard clock signal after performing digital signal processing of the digital image signal, and obtaining an improved analog image signal; and supplying the improved analog image signal to a corresponding pixel and obtaining an image.

According to a fourth aspect of the present invention, there is provided a method of driving a semiconductor display device, comprising the steps of:

performing frequency modulation of a first standard clock signal and obtaining a first modulated clock signal;

performing frequency modulation of a second standard clock signal and obtaining a second modulated clock signal;

selecting a gate signal line based upon the first modulated clock signal;

sampling an analog image signal based on the second modulated clock signal, performing A/D conversion, and obtaining a digital image signal;

performing D/A conversion based on the second standard clock signal after performing digital signal processing of the digital image signal, and obtaining an improved analog image signal; and supplying the improved analog image signal to a corresponding pixel and obtaining an image.

According to a fifth aspect of the present invention, there is provided a method of driving a semiconductor display device, comprising the steps of:

performing frequency modulation of a first standard clock signal and obtaining a first modulated clock signal;

performing frequency modulation of a second standard clock signal and obtaining a second modulated clock signal;

selecting a gate signal line based upon the first modulated clock signal;

sampling an analog image signal based on the second modulated clock signal, performing A/D conversion, and obtaining a digital image signal;

performing D/A conversion based on the second modulated clock signal after performing digital signal processing of the digital image signal, and obtaining an improved analog image signal; and supplying the improved analog image signal to a corresponding pixel and obtaining an image.

According to a sixth aspect of the present invention, there is provided a method of driving a semiconductor display device, comprising the steps of:

performing frequency modulation of a first standard clock signal and obtaining a first modulated clock signal;

performing frequency modulation of a second standard clock signal and obtaining a second modulated clock signal;

selecting a gate signal line based upon the first modulated clock signal;

sampling an analog image signal based on the second modulated clock signal, performing A/D conversion, and obtaining a digital image signal;

performing D/A conversion based on the second modulated clock signal after performing digital signal processing of the digital image signal, and obtaining an improved analog image signal; and supplying the improved analog image signal to a corresponding pixel and obtaining an image.

In the method of driving a semiconductor display device according to a seventh aspect of the present invention, the modulated clock signal may also be obtained by raising or lowering the frequency of the standard clock signal at a constant period.

In the method of driving a semiconductor display device according to an eighth aspect of the present invention, the modulated clock signal may also be obtained by shifting the frequency of the standard clock signal based on a Gaussian histogram.

In the method of driving a semiconductor display device according to a ninth aspect of the present invention, the modulated clock signal may also be obtained by randomly shifting the frequency of the standard clock signal.

In the method of driving a semiconductor display device according to a tenth aspect of the present invention, the modulated clock signal may also be obtained by sinusoidally shifting the frequency of the standard clock signal.

In the method of driving a semiconductor display device according to an eleventh aspect of the present invention, the modulated clock signal may also be obtained by shifting the frequency of the standard clock signal by using a triangular wave.

According to a twelfth aspect of the present invention, there is provided a semiconductor display device comprising:

an active matrix circuit having a plurality of transistors arranged in a matrix shape; and a gate signal line side driver circuit and a source signal line side driver circuit for driving the active matrix circuit;

characterized in that a first modulated clock signal in which a first standard clock signal is frequency modulated, is input to the gate signal line side driver circuit, and a second standard clock signal is input to the source signal line side driver circuit.

According to a thirteenth aspect of the present invention, there is provided a semiconductor display device comprising:

an active matrix circuit having a plurality of transistors arranged in a matrix shape; and a gate signal line side driver circuit and a source signal line side driver circuit for driving the active matrix circuit;

characterized in that a first modulated clock signal, in which a first standard clock signal is frequency modulated, is input to the gate signal line side driver circuit, and a second modulated clock signal, in which a second standard clock signal is frequency modulated, is input to the source signal line side driver circuit.

According to a fourteenth aspect of the present invention, there is provided a semiconductor display device comprising a passive matrix circuit, characterized in that:

a first modulated clock signal, in which a first standard clock signal is frequency modulated, is input to a scanning electrode of the passive matrix circuit; and an image signal sampled based on a second clock signal is input to a signal electrode of the passive matrix circuit.

According to a fifteenth aspect of the present invention, there is provided a semiconductor display device comprising a passive matrix circuit, characterized in that:

a first modulated clock signal, in which a first standard clock signal is frequency modulated, is input to a scanning electrode of the passive matrix circuit; and an image signal sampled based on a second modulated clock signal, in which a second standard clock signal is frequency modulated, is input to a signal electrode of the passive matrix circuit.

In a semiconductor display device according to a sixteenth aspect of the present invention, the modulated clock signal may also be obtained by raising or lowering the frequency of the standard clock signal at a constant period.

In a semiconductor display device according to a seventeenth aspect of the present invention, the modulated clock signal may also be obtained by shifting the frequency of the standard clock signal based on a Gaussian histogram.

In a semiconductor display device according to an eighteenth aspect of the present invention, the modulated clock signal may also be obtained by randomly shifting the frequency of the standard clock signal.

In a semiconductor display device according to a nineteenth aspect of the present invention, the modulated clock signal may also be obtained by sinusoidally shifting the frequency of the standard clock signal.

In a semiconductor display device according to a twentieth aspect of the present invention, the modulated clock signal may also be obtained by shifting the frequency of the standard clock signal by using a triangular wave.

BRIEF DESCRIPTION OF THE DRAWINGS

In the accompanying drawings:

FIGS. 8A to 8C are diagrams showing a modulation clock signal;

DETAILED DESCRIPTION OF THE PREFERRED EMBODIMENTS

[Embodiment Mode]

Driving methods of the present invention are explained in order. As an example, a method of converting the format of a video signal when an image signal corresponding to a low resolution (m×n pixels) is displayed in an active matrix semiconductor display device corresponding to a high resolution (m'×n' pixels), and utilizing the Mach phenomenon and the Craik-O'Brien phenomenon to improve visual resolution is explained.

Figure 1:
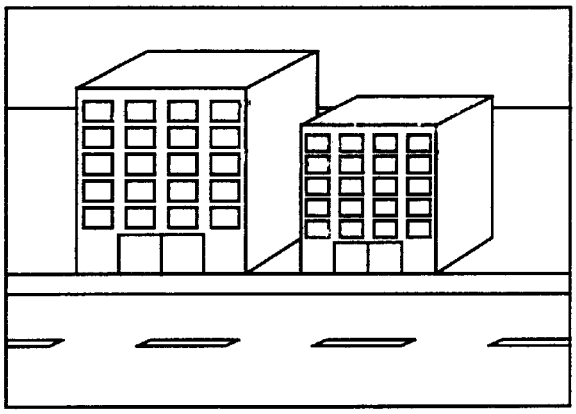
FIG. 1 is a conceptual diagram in which a low resolution image is displayed in an active matrix semiconductor display device corresponding to high resolution.
Figure 1:
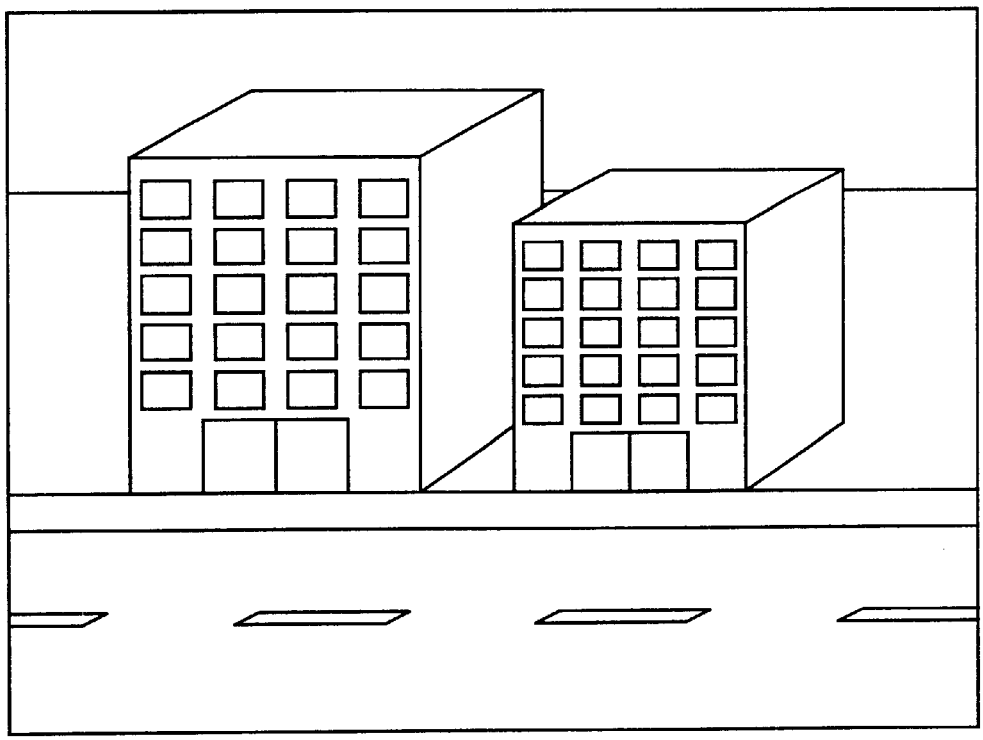

Please refer to FIG. 1. A state of performing format conversion of a video signal for explaining the present invention is shown in FIG. 1. As an example, format conversion from VGA (640×480 pixels) to SXGA (1280×1024 pixels) is shown, but low resolution is not limited to VGA (640×480 pixels) in the present invention, of course. High resolution is not limited to SXGA (1280×1024 pixels).

Figure 2A:
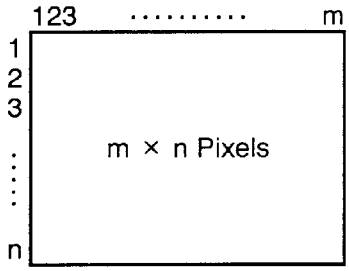
FIG. 2A and FIG. 2B are diagrams showing a state of sampling a video signal corresponding to a low resolution by a semiconductor display device corresponding to low resolution and to high resolution.
Figure 2B:
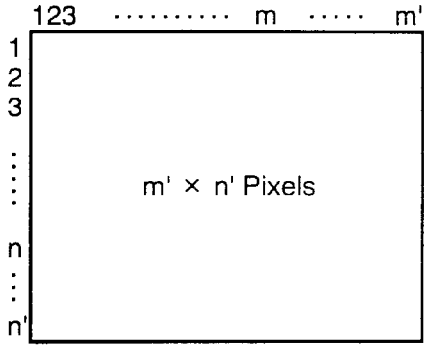
Figure 2B:
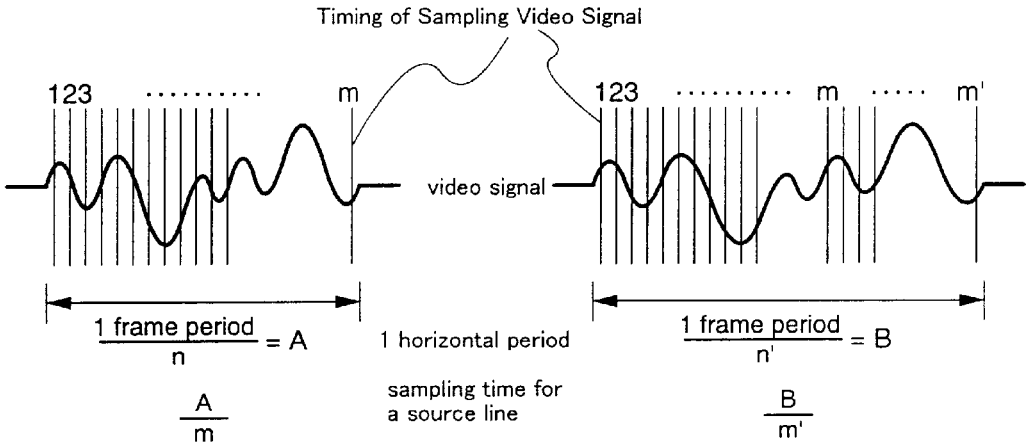

Please refer to FIGS. 2A and 2B. A state of sampling video signals in source signal lines of active matrix semiconductor display devices corresponding to low resolution (m×n pixels) and to high resolution (m'×n' pixels) is shown in FIG. 2A and FIG. 2B, respectively. The video signals in FIGS. 2A and 2B are identical and correspond to low resolution (m×n pixels). At this point, the video signals are input for one horizontal period, and are not dependent on the number of source signal lines. In other words, by sampling the video signal for one horizontal period in m source signal lines in FIG. 2A, while sampling the same video signal for horizontal period in m' source signal lines in FIG. 2B, the resolution of the horizontal direction can be converted. This can easily be solved by raising the operation clock of the circuit.

Figure 3:
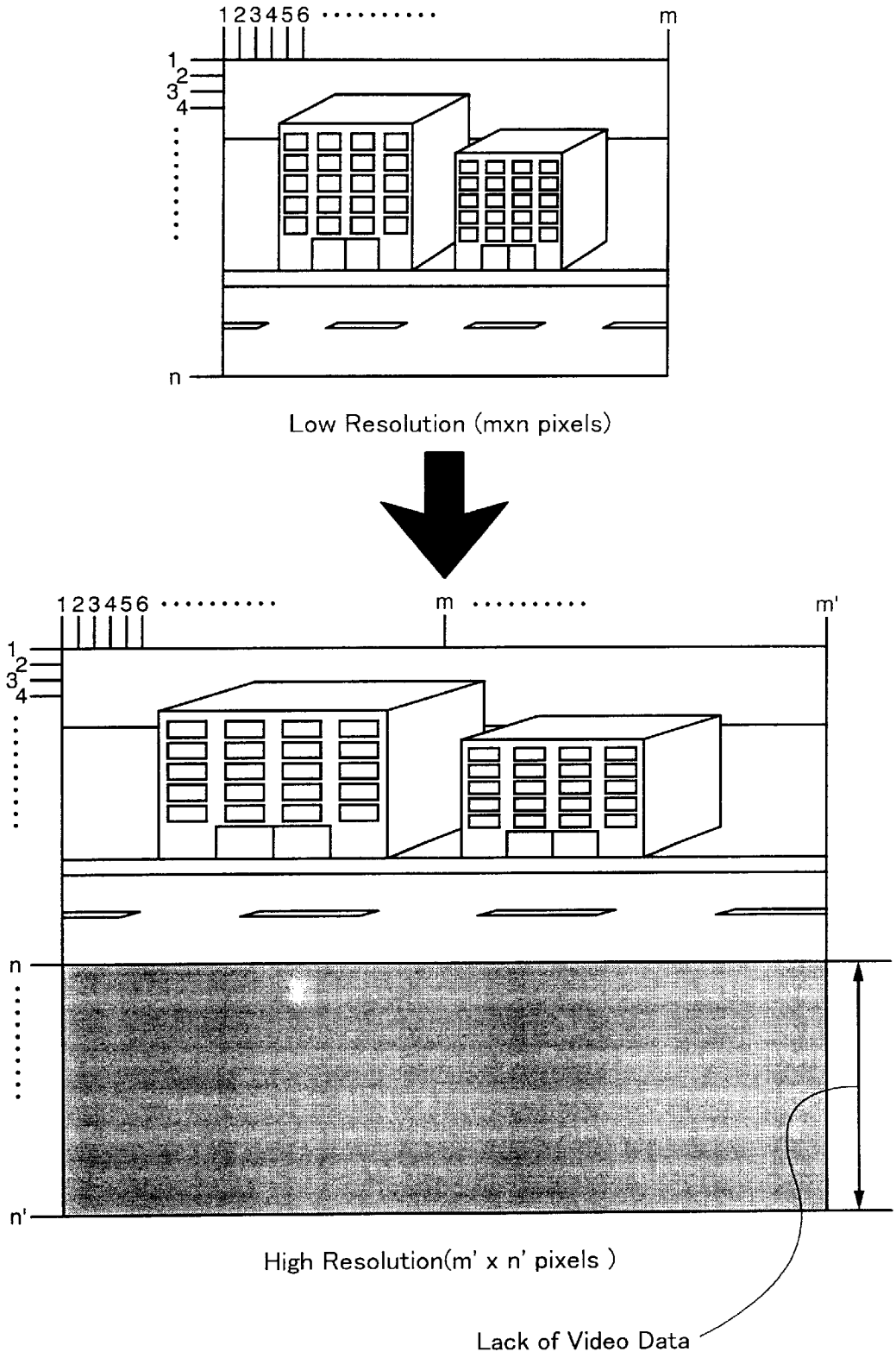
FIG. 3 is a diagram showing an insufficiency of a video signal when a low resolution image is displayed, without performing vertical direction format conversion, in an active matrix semiconductor display device corresponding to high resolution.

A method of format conversion in the vertical direction is explained next. FIG. 3 shows one frame portion extracted from a state of performing resolution conversion only in the source signal side and inputting a video signal corresponding to low resolution (m×n pixels) to the active matrix semiconductor display device corresponding to high resolution (m'×n' pixels). Resolution conversion in the horizontal direction is performed by the method stated above the video signal for each single frame is structured by gathering the video signal of one horizontal period in accordance with the number of gate signal lines, and therefore the video signal of each becomes dependent upon the number of gate signal lines. Therefore, when displaying a video signal corresponding to low resolution (m×n pixels) by an active matrix semiconductor display device corresponding to high resolution (m'×n' pixels), a region in which there is no display by the lack of the video signal develops corresponding the difference in the number of gate signal lines, as shown in the lower portion of FIG. 3. In other words, in the n+1 row, the first row of the video signal of the next frame is input, and normal display cannot be performed.

By selecting a plurality of gate signal lines simultaneously, and by adjusting the number of virtual vertical scans to the number of video signals corresponding to low resolution, the above problem is solved.

Figure 4A:
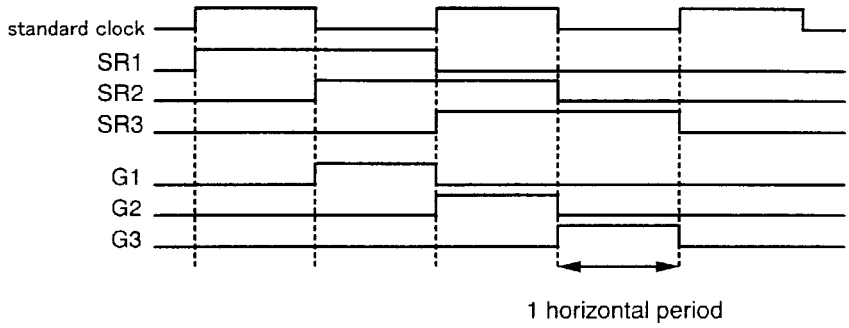
FIGS. 4A to 4C are diagrams showing examples of a clock signal for selecting a plurality of gate signal lines simultaneously, shift register output, and output of a gate signal line selection pulse, respectively.
Figure 4B:
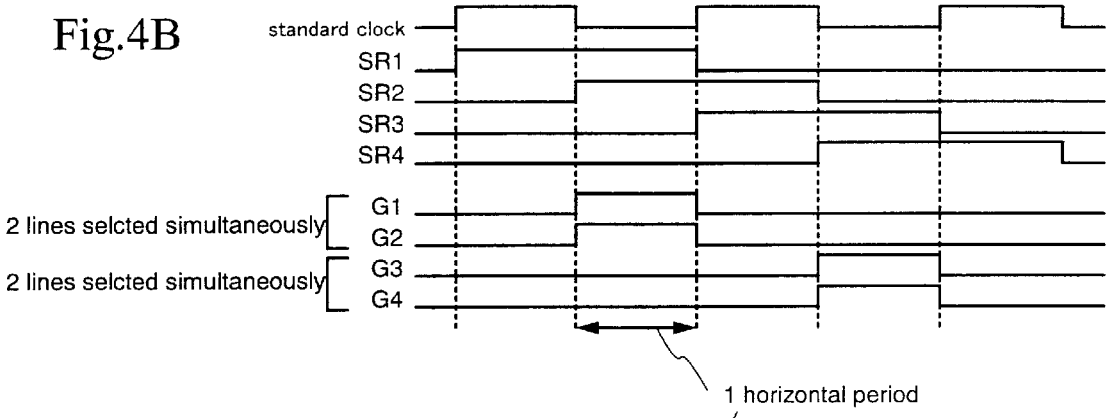
Figure 4C:
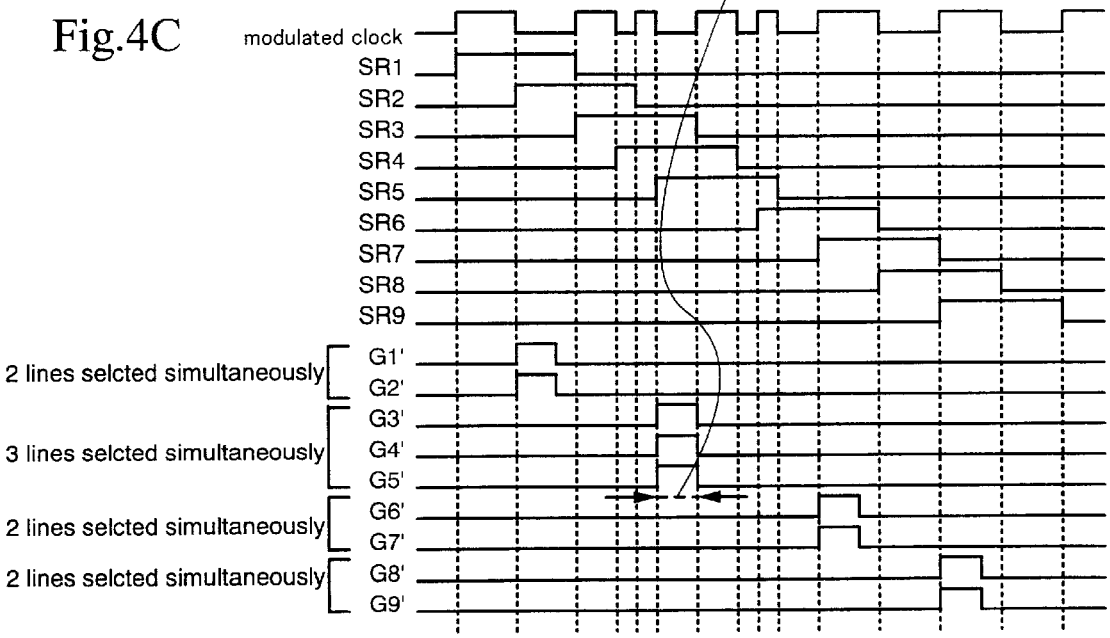
Figure 5:
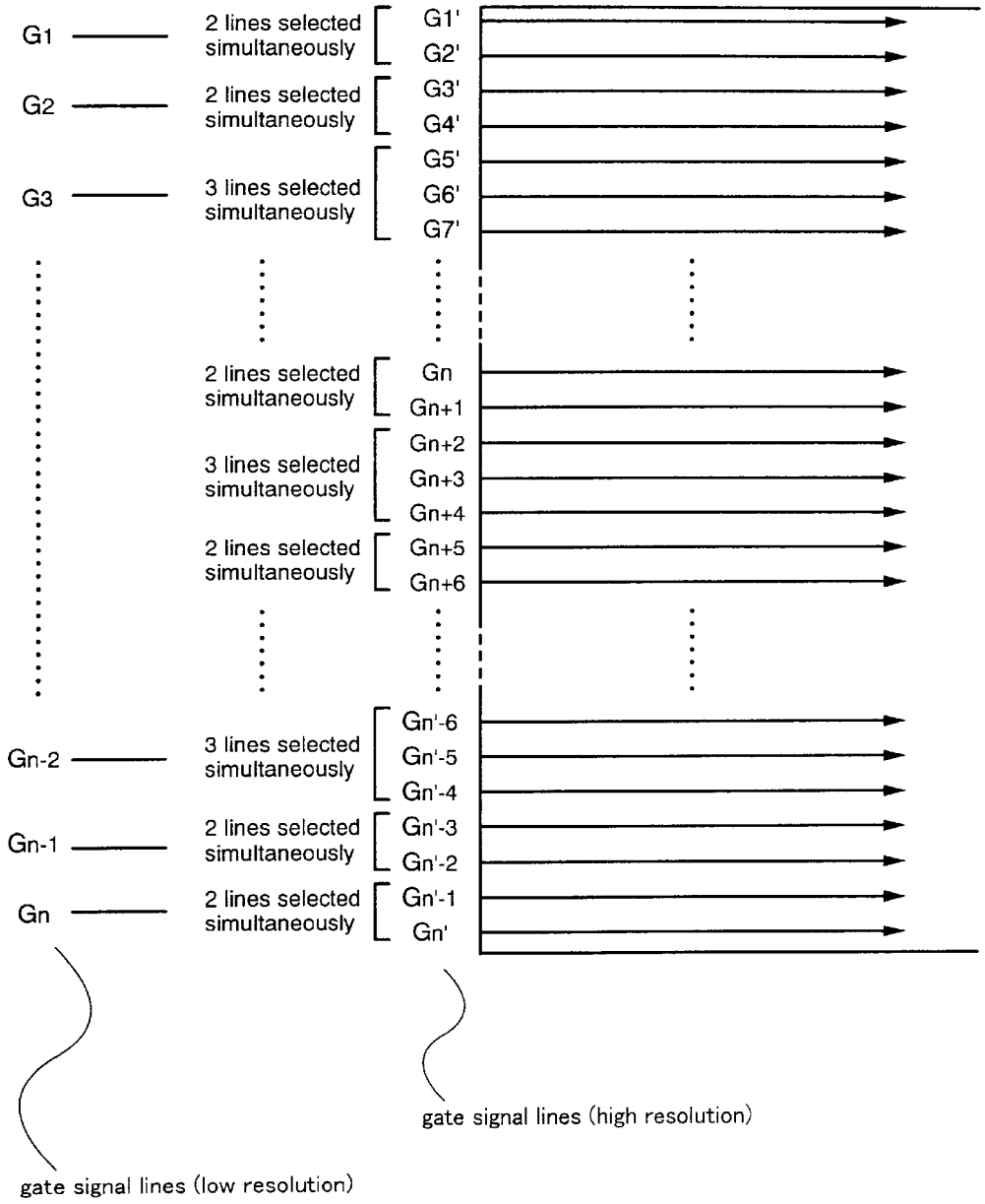
FIG. 5 is a diagram showing simultaneous selection of a plurality of gate signal lines.

Please refer to FIGS. 4A to 4C and to FIG. 5. Reference symbols SR1 to SR9 in FIGS. 4A, 4B, and 4C denote output pulses from a shift register circuit, and reference symbols G1 to G9 denote selection pulses from gate signal lines. FIG. 4A shows normal output of gate signal lines. As shown in FIG. 4A, normally the gate signal line selection pulses are output so as not to overlap with each other, and the gate signal lines are selected in order. In order to select a plurality of gate signal lines simultaneously, the gate signal line selection pulses may be extracted at a timing in which a plurality of adjacent shift register output pulses overlap, as shown in FIG. 4B. It is can be seen that the gate signal line selection pulses G1 and G2 are output simultaneously at a timing in which SR1 and SR2 overlap. Similarly, G3 and G4 are output simultaneously at a timing in which SR3 and SR4 overlap.

Please refer to FIG. 4C. FIG. 4C is an example of a case in which for selecting 2 lines simultaneously and selecting 3 lines simultaneously intermingle. The starting timing of the shift register output is shifted and an overlap of a plurality of shift register output pulses is made to develop by using the above stated modulation clock signal in this type of case. In FIG. 4C, the outputs of the three pulses SR3, SR4, and SR5, output at a timing in which a modulation is added to the clock signal, become front-loaded, and overlapping portions appear. When 3 lines are simultaneously selected, the gate selection pulses may be output at this timing. In the example of FIG. 4C, the selection pulses G1 and G2 are output simultaneously to two lines, the selection pulses G3 to G5 are output simultaneously to three lines, G6 and G7 are output simultaneously to two lines, and G8 and G9 are output simultaneously to two lines. Note that an example of a case of simultaneously selecting two lines or three lines is explained here, but it is also possible to simultaneously select four or more lines by a similar method.

Please refer to FIG. 5. Reference symbols G1 to Gn show gate signal lines of an active matrix semiconductor display device corresponding to low resolution (m×n pixels), and reference symbols G1' to Gn' show gate signal lines of an active matrix semiconductor display device corresponding to high resolution (m'×n' pixels). In accordance with selecting two lines or three lines of the gate signal lines simultaneously by the above stated method, the number of the gate signal lines of the active matrix semiconductor display device corresponding to high resolution (m'×n' pixels) and the number of the gate signal lines of the active matrix semiconductor display device corresponding to low resolution (m×n pixels) appear to become equal. Therefore, a video signal corresponding to low resolution (m×n pixels) can be displayed normally by an active matrix semiconductor display device corresponding to high resolution (m'×n' pixels). A size format conversion which cannot be completely performed by only reducing the clock frequency can thus be completely performed.

A method of driving on the source signal line and the gate signal line in order to improve the apparent resolution by utilizing the Mach phenomenon and the Craik-O'Brien phenomenon in the present invention is explained next.

Figure 6:
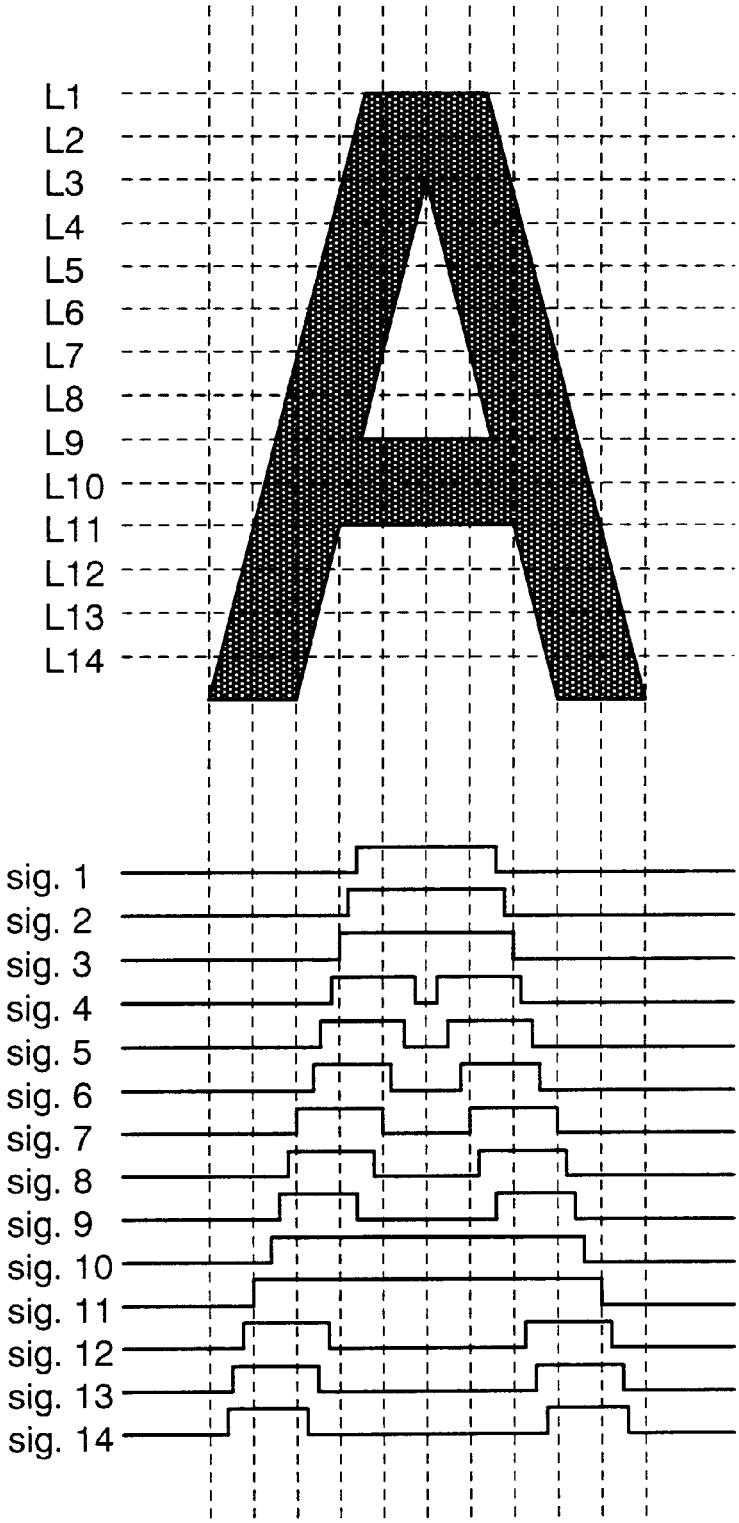
FIG. 6 is a diagram showing a waveform of a video signal based on an source image.

Please refer to FIG. 6. A state of converting a source image to video signal in order to explain the present invention is shown in FIG. 6. An source image "A" is changed to a video signal of lines L1 to L14. Note that the source image "A" is shown with a black color on a white color background in FIG. 6, and the source image "A" has a uniform brightness without shading. The video signal corresponding to each of the source image lines L1 to L14 is shown by reference symbols sig. 1 to sig. 14.

Figure 7:
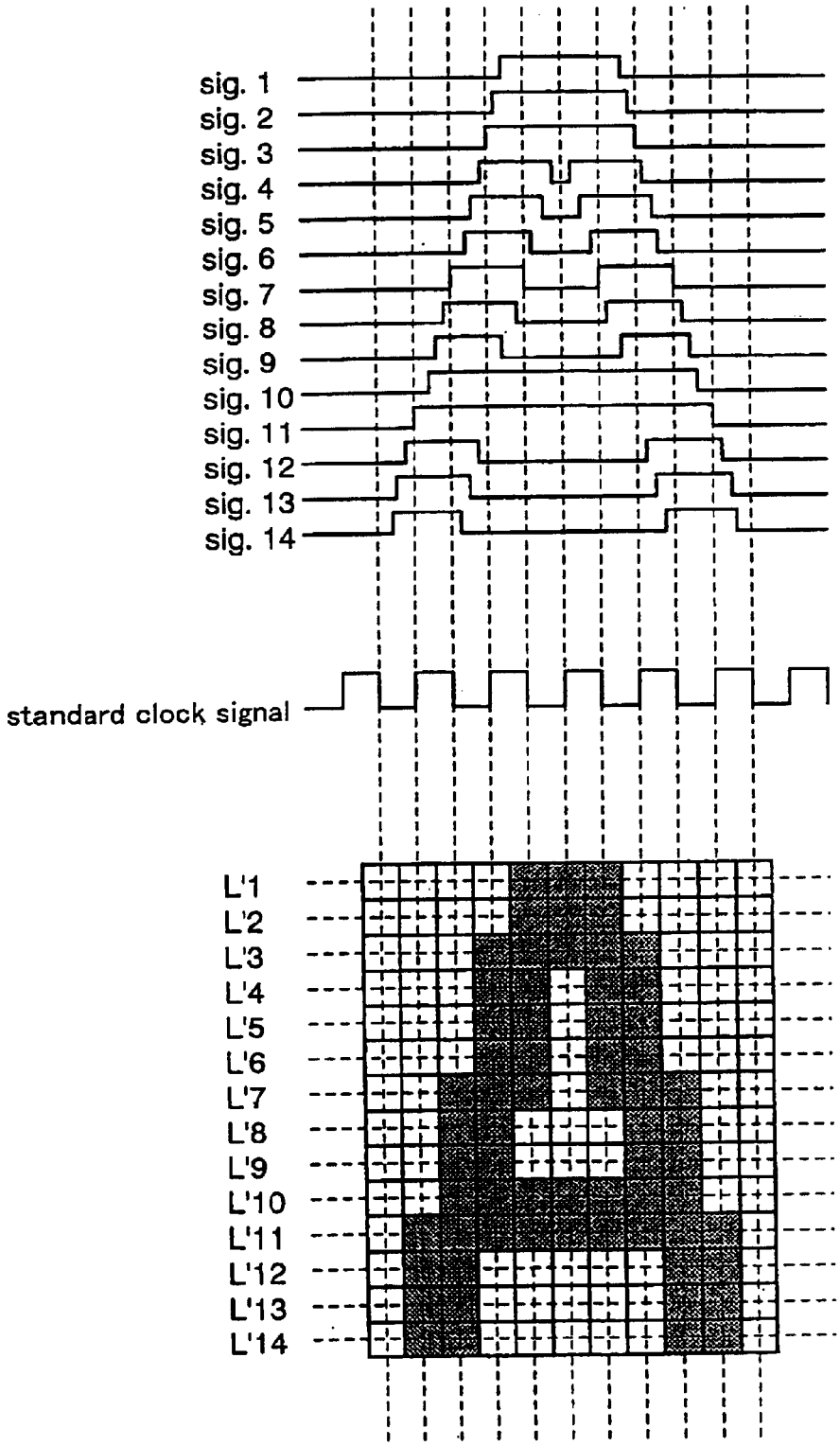
Fig. 7 PRIOR ART
FIG. 7 is a diagram showing a screen display example of an active matrix semiconductor display device in the case of sampling a video signal by a driving method in accordance with a standard clock.

Please refer to FIG. 7 next. A state of sampling each of the video signals sig. 1 to sig. 14 based on the source image "A" by a conventional standard clock signal, and displaying on a screen of an active matrix semiconductor display device is shown in FIG. 7. Note that squares shown as being centered at intersections of dashed lines extended from the video signals and dashed lines showing each line L'1 to L'14 of the image display are pixels of the active matrix semiconductor display device.

The video signal of each line is sampled by the standard clock signal. The video signal is sampled here when the standard clock signal pulse rises and falls. Image information is written into each pixel of the semiconductor display device in accordance with the sampled video signal, and the image is displayed as full-screen. Pixels shown with black in the screen display are pixels into which image information is written. The image can thus be obtained as an aggregate of the image information written into the pixels in the active matrix semiconductor display device. In general, a screen display of an active matrix semiconductor display device is performed by this type of image information write-in approximately 60 times per second.

A driving method of the present invention using a modulated clock signal, which is frequency modulated at a certain constant frequency, is explained next. Please refer to FIGS. 8A to 8C. A standard clock signal and a modulated clock signal, which is frequency modulated at a certain constant frequency, are shown in FIG. 8A. Changes of the frequency of the modulated clock signal are explained here as displacements when the pulse starts up or stops in the time axis. First, a pulse hold period $T_H$ of the standard clock signal (a period from the start of the pulse to the end of the pulse, or a period from the end of the pulse to the start of the pulse) is considered as divided into 5 equal parts, and the period in which the hold period $T_H$ is divided into 5 equal parts is taken as t ($T_H$=5 t). With the standard clock signal pulse as the standard, temporal displacements of the start time and end time of the pulse are considered. In the example given here, temporal displacements of the start time and end time of the pulse change in accordance with 0→+t→−t→0→+2t→0→−2t→0→+t→−t→0→+t→. . . with the start time and the end time of the standard clock pulse taken as the standard, as shown in FIG. 8B. The reference symbol "+t" denotes a displacement of an advancement by time t here, the reference symbol "0" denotes no displacement, and the reference symbol "−t" denotes a displacement of a lag by time t. These temporal displacements are in accordance with a Gaussian histogram shown in FIG. 8C. Thus, the modulated clock signal given here can be obtained by a displacement of ±2t or ±t in time with the start time and end time of the pulse of the standard clock signal taken as the standard. Further, one period of the modulated clock signal is 5 pulses.

A frequency shift from approximately +67% to approximately −29% is obtained for the modulated clock signal, with the frequency of the standard clock signal taken as 100%.

Figure 9:
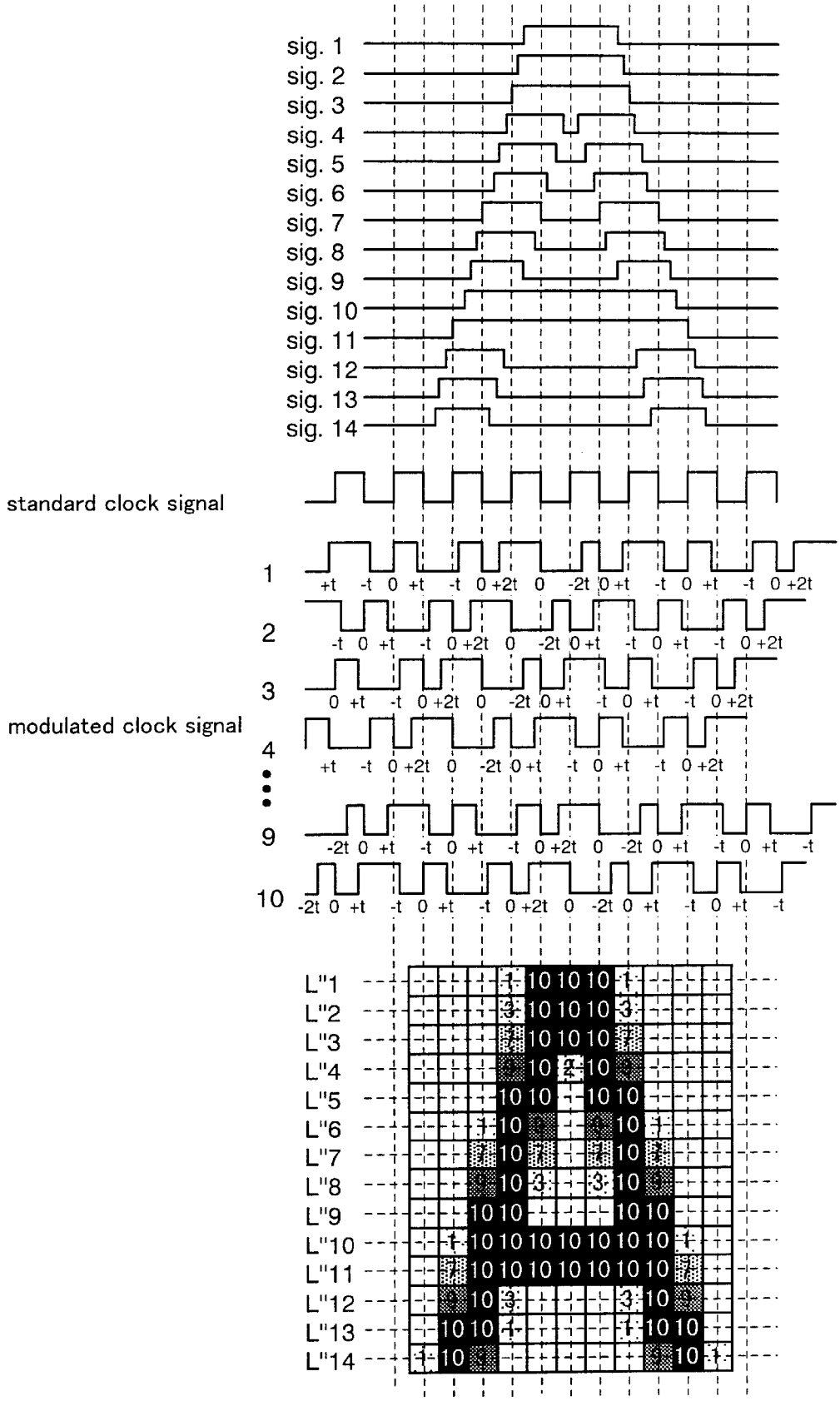
FIG. 9 is a diagram showing an screen display example of an active matrix semiconductor display device in the case of sampling a video signal by a driving method in accordance with a modulation clock of the present invention.

Please refer to FIG. 9. A screen display in accordance with sampling the video signal of each line by the modulated clock signal according to the driving method of the present invention and in accordance with lines L"1 to L"14 is shown in FIG. 9. The modulated clock signal explained with FIG. 8 above is used in FIG. 9. Further, the video signal of each line shown in FIG. 6 described above is used here. Note that the standard clock signal is also shown in the figure for comparison.

Video signals sig. 1 to sig. 14 of respective lines are sampled at the start time and the end time of the modulated clock signal pulse, and written into corresponding pixels as image information.

First, each video signal of sig. 1 to sig. 14 is sampled at a pulse timing of a modulated clock signal 1, and image information is written into the corresponding pixels in a first frame. Next, in a second frame, each of the video signals sig. 1 to sig. 14 are sampled at a pulse timing of a modulated clock signal 2, and image information is written into the corresponding pixels. The modulated clock signal 1 and the modulated clock signal 2 deviate by 1/10 period. In addition, each of the video signals sig. 1 to sig. 14 are sampled at a pulse timing of a modulated clock signal 3, and image information is written into the corresponding pixels in a third frame. Note that the modulated clock signal 2 and the modulated clock signal 3 deviate by 1/10 period. The sampling of the video signal from the first to the tenth frame, and the write-in of image information to the corresponding pixels, is thus performed in order.

A screen display when ten frames of image information have been written is shown in the bottom of FIG. 9 as the display of the lines L"1 to L"14. Note that numerals 1, 2, 3, 7, 9, or 10 are entered into each pixel of FIG. 9. These numerals denote how many times a signal for displaying "black" is written into each pixel during the ten frame write-in time (for example, the numeral 1 denotes 1 time, the numeral 7 denotes 7 times, and the numeral 10 denotes 10 times).

Figure 10A:
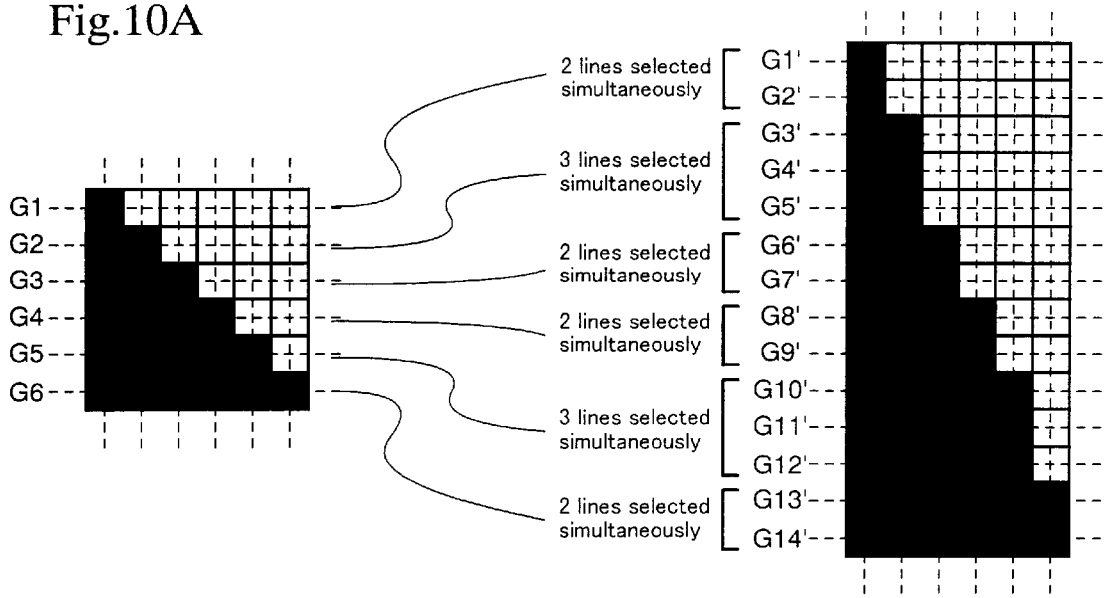
FIGS. 10A and 10C are diagrams showing screen display examples of an active matrix semiconductor display device in the case of extending a video signal corresponding to low resolution in accordance with a format conversion method of the present invention.
Figure 10B:
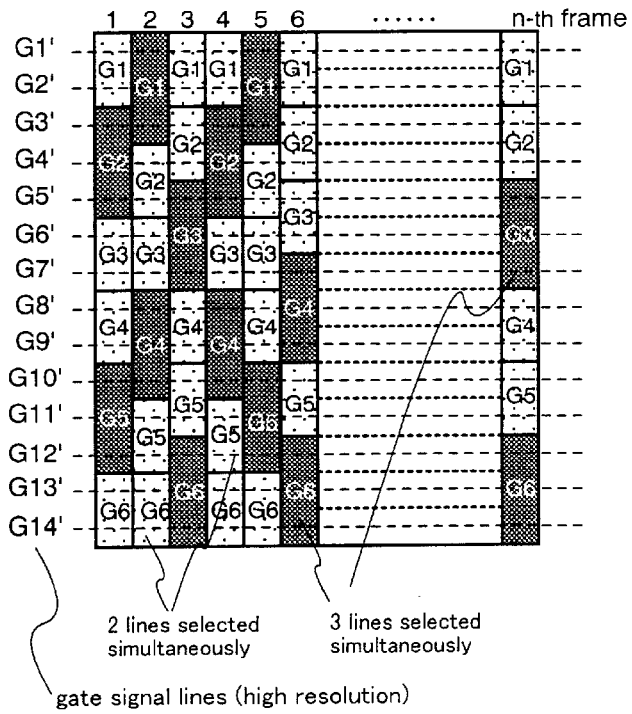
Figure 10C:
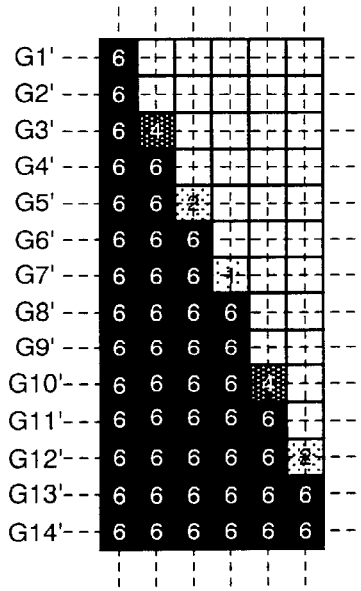

Please refer to FIGS. 10A to 10C next. A state of extending a video signal in accordance with a format conversion in the vertical direction is shown in the left side of FIG. 10A. In order to simplify the explanation here, the format conversion is only performed in the vertical direction, and only a portion of a screen (6×6 pixels) is shown as a blow-up. Dashed lines G1 to G6 of the left side of FIG. 10A are gate signal lines in a screen corresponding to low resolution, and dashed lines G1' to G14' of the right side of FIG. 10A are gate signal lines in a screen corresponding to high resolution. Note that squares shown as being centered at the intersections of the dashed lines G1 to G6 and the dashed lines G1' to G14' showing the gate signal lines, and dashed lines in the vertical direction denoting source signal lines are respective pixels of an active matrix semiconductor display device.

If format conversion is performed by selecting a plurality of lines simultaneously by the above method, then as shown in the right side of FIG. 10A, the extension of the video signal develops a non-uniform portion in a portion where, for example, two lines are simultaneously selected and in a portion where three lines are simultaneously selected and therefore causes a decrease in image quality in an outline portion.

By driving a gate signal line side driver circuit in accordance with a modulated clock, the timing at which simultaneous selection is performed is made to shift for each frame. Please refer to FIG. 10B. In a first frame, Gi' and G2' are simultaneously selected, and the signal of G1 is input. Then G3' to G5' are simultaneously selected, and the signal of G2 is input. Similarly, the signal of G6 is input to G'13 and G14', and it can be seen that the format conversion of a first frame is performed normally. For a second and later frames, simultaneous selection of two lines and three lines is performed at a different order from that of the first frame, and screen display is performed for one period up to an nth frame.

Note that how many frames one period is set to may be determined based on the formats of a conversion source and a conversion destination.

The screen display at a time when the first six frames of the image information have been written-in is shown in FIG. 10C. Note that numerals 1, 2, 4, and 6 are entered into each of the pixels of FIG. 10C. These numerals denote how many times a signal for displaying "black" is written into the pixels during the six frame write-in time (for example, the numeral 1 denotes 1 time, the numeral 2 denotes 2 times, and the numeral 6 denotes 6 times).

As can be understood from the screen display examples of the bottom of FIG. 9 and of FIG. 10C, when compared to a driving method using a conventional standard clock, there are frames in which image information is written and frames in which image information is not written in the outline portion of the image according to the drivin, method of the present invention using the modulated clock signal. This is therefore expressed by the pixels as shading information. An image having shading information in the outline portion of the image can thus be seen by an observer as appearing to have an increased resolution in accordance with the above stated visual Mach phenomenon and the Craik-O'Brien phenomenon.

[Embodiments]

Specific examples of the driving method according to the present invention, and semiconductor devices using the driving method, are explained here using the following embodiments. However, the present invention is not limited to the following embodiments.

[Embodiment 1]

An example of an active matrix semiconductor display device as a semiconductor display device capable of using a method of driving a semiconductor device display device according to the present invention is explained below.

Figure 11:
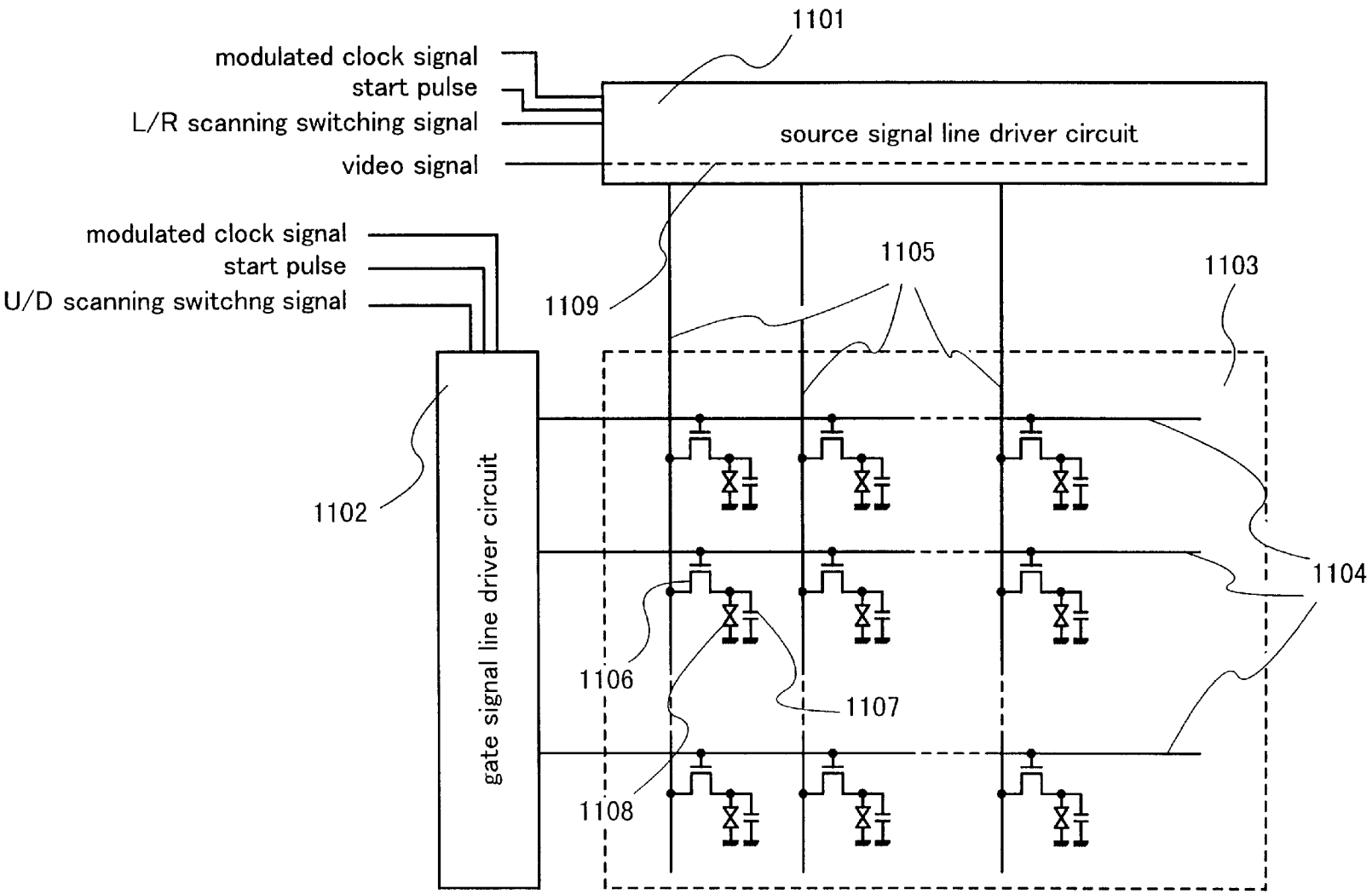
FIG. 11 is a schematic structure diagram of an active matrix semiconductor display device in accordance with Embodiment 1.

Please refer to FIG. 11. A schematic structure diagram of the active matrix semiconductor display device of Embodiment 1 is shown in FIG. 11. Reference numeral 1101 denotes a source signal line driver circuit, and signals such as a modulated clock, a start pulse, and a left-right scanning switching signal are input. Reference numeral 1102 denotes a gate signal line driver circuit, and signals such as a modulated clock, a start pulse, and an up-down scanning switching signal are input. Throughout this specification, the modulated clock signal refers to a clock signal which has been frequency modulated. Reference numeral 1103 denotes an active matrix circuit, and the active matrix circuit has pixels arranged in a matrix state at each intersection of gate signal lines 1104 and source signal lines 1105. Each of the pixels has a pixel TFT 1106. Further, a pixel electrode (not shown in the figure) and a supplementary capacitor 1107 are connected to a drain electrode of the pixel TFTs. Furthermore, reference numeral 1108 denotes a liquid crystal sandwiched between the active matrix circuit and an opposing substrate (not shown in the figure). Reference numeral 1109 denotes a video signal, and the video signal is input from the outside.

Furthermore, the gate signal line driver circuit is only arranged in the left side of the active matrix circuit 1103 in FIG. 11, but it may also be symmetrically arranged on both left and right sides. This type of arrangement is effective from a standpoint of operation reliability and efficiency.

Figure 12:
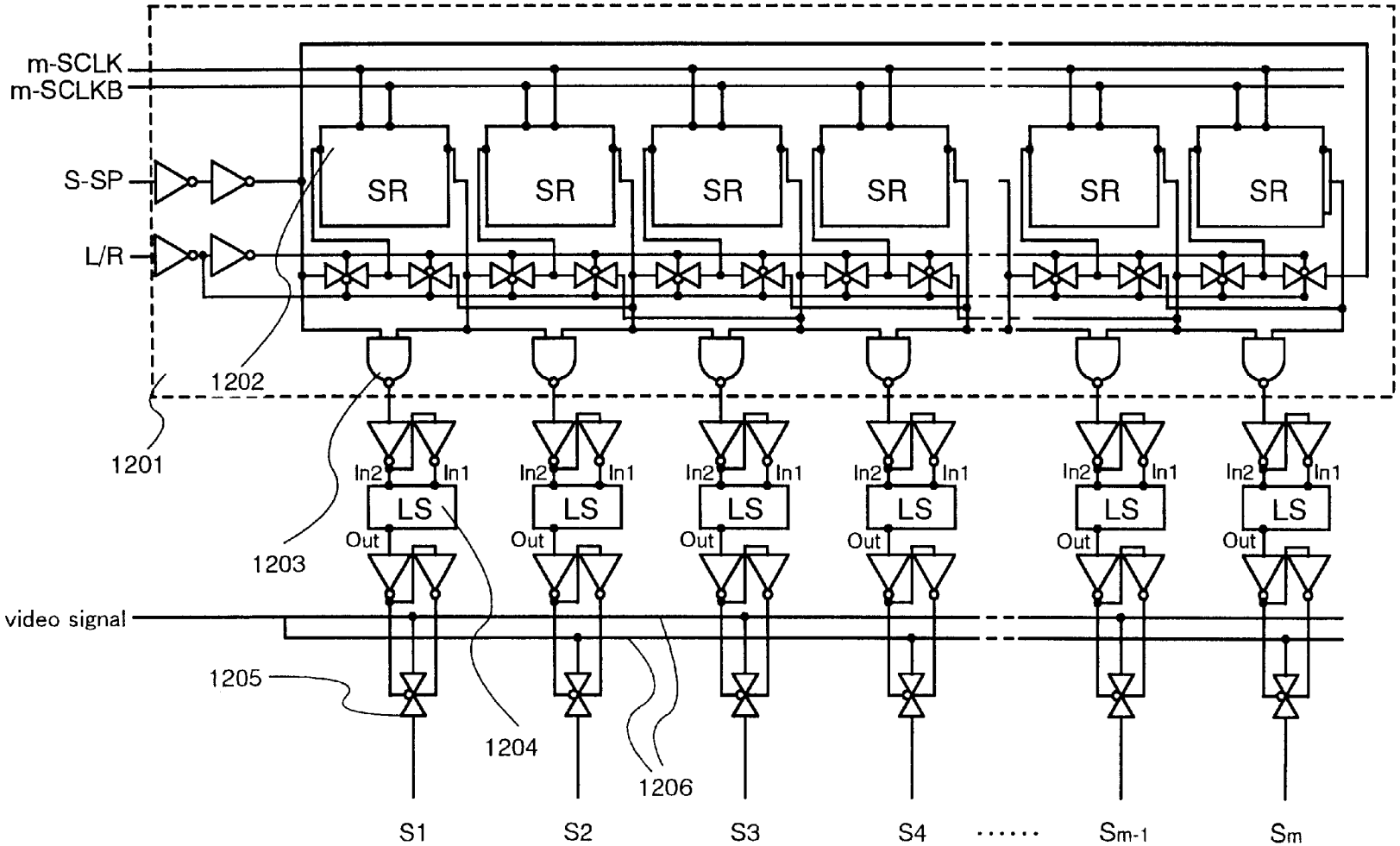
FIG. 12 is a circuit diagram of a source signal line driver circuit of the active matrix semiconductor display device in accordance with Embodiment 1.

Please refer to FIG. 12 next. A circuit structure diagram of the source signal line driver circuit of the active matrix semiconductor display device of Embodiment 1 is shown in FIG. 12. Reference numeral 1201 denotes a shift register circuit. The shift register circuit 1201 has components such as a shift register main body 1202 and a NAND circuit 1203. Reference numeral 1204 denotes a level shifter circuit, reference numeral 1205 denotes an analog switch circuit, and reference numeral 1206 denotes a video signal line.

A modulated clock signal m-SCLK, an inverted clock signal M-SCLKB, a source side start pulse S-SP, and a left-right scanning switching signal (L/R) are input to the source signal line side driver circuit.

The shift register circuit 1201 operates in accordance with the externally input modulated clock signal m-SCLK, an inverted modulated clock signal m-SCLKB, the source side start pulse S-SP, and the left-right scanning switching signal (L/R) which are input from the outside. When HI is input to the left-right scanning switching signal (L/R), signals for sampling the video signal are output from the NAND circuits 1203 in order from the left toward the right. The signals for sampling the video signal have their voltage level shifted to high voltage by the level shifter circuits 1204, and are input to the analog switches 1205. The analog switches 1205 sample the video signal supplied from the video signal line 1206 in accordance with the input of the sampling signal, and supply the source signal lines S1 to Sm. The video signal supplied to the source signal lines is supplied to TFTs of the corresponding pixels.

Figure 13:
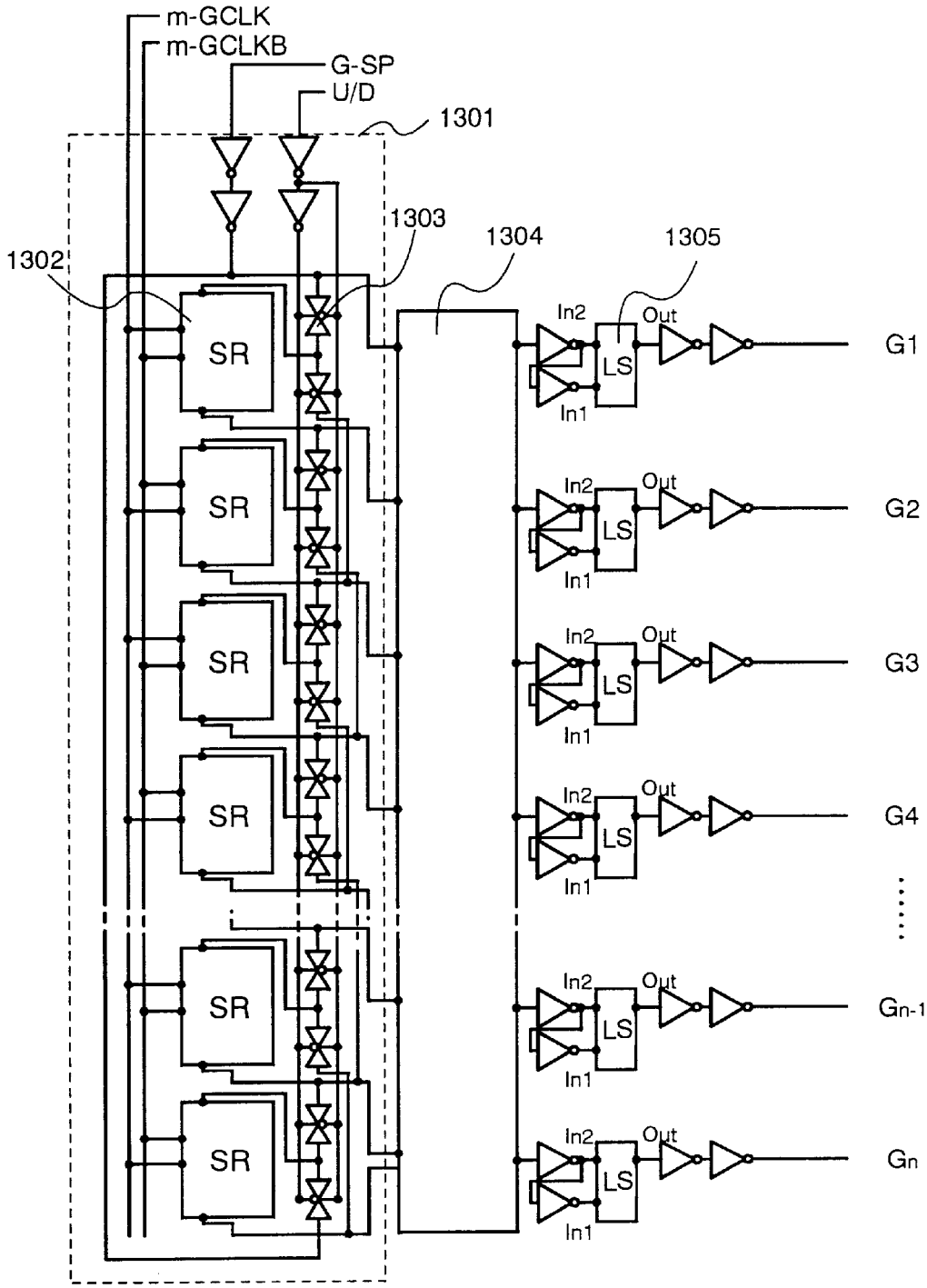
FIG. 13 is a circuit diagram of a gate signal line driver circuit of the active matrix semiconductor display device in accordance with Embodiment 1.

A circuit structure of the gate signal line driver circuit of the active matrix semiconductor display device of Embodiment 1 is explained. Please refer to FIG. 13. Reference numeral 1301 denotes a shift register circuit. The shift register circuit 1301 has components such as a shift register main body 1302 and an analog switch 1303. Reference numeral 1304 denotes a pulse selection circuit, and reference numeral 1305 denotes a level shifter circuit.

A modulated clock signal m-GCLK, an inverted clock signal m-GCLKB, a gate side start pulse GSP, and an up-down scanning switching signal (U/D) are input to the gate signal line side driver circuit.

The shift register circuit 1301 operates in accordance with the externally input modulated clock signal m-GCLK, the inverted modulated clock signal m-GCLKB, the gate side start pulse GSP, and the up-down scanning switch signal (U/D) which are input from the outside. When HI is input to the up-down scanning switch signal (U/D), shift register output pulses are output in order from the top toward the bottom. The shift register output pulses are next input to the pulse selection circuit 1304, and the pulse selection circuit outputs gate selection pulses at a timing for simultaneous selection of a plurality of gate signal lines, adjusted to the format of the input video signal. Then the gate selection pulses have their voltage level shifted to high voltage by the level shifter circuits 1305 and are output from the gate signal lines G1 to Gn.

Note that a module such as an IC WORKS Corp. W42C31-09 module can be given as one for obtaining the modulated clock.

[Embodiment 2]

In the description of the present embodiment, reference will be made to a case in which a modulated clock signal is used in an active matrix liquid crystal display device having a digital driving circuit. In the active matrix liquid crystal display device of the present embodiment, an analog image signal such as a high-definition television signal or an NTSC signal to be externally supplied is converted into a digital image signal by A/D conversion (analog/digital conversion). The sampling of the analog image signal during the A/D conversion is performed by using the modulated clock signal. The digital image signal is subjected to digital signal processing such as gamma correction and aperture control, and is then converted into an improved analog image signal by D/A conversion (digital/analog conversion) using a fixed clock. The improved analog image signal is written to its corresponding pixels. In this manner, the digital signal processing of an image signal can be effected, whereby an observer can obverse the image signal as an image with resolution which is apparently improved, as described above in connection with the aforesaid mode for carrying out the present invention as well as the aforesaid embodiments of the same.

The following method is available as another driving method according to the present embodiment. An analog image signal such as a high-definition television signal or an NTSC signal to be externally supplied is converted into a digital image signal by A/D conversion (analog/digital conversion) at sampling timing due to a fixed clock signal. The digital image signal is subjected to digital signal processing such as gamma correction and aperture control, and is then converted into an improved analog signal image by D/A conversion using a modulated clock signal. The improved analog image signal is written to its corresponding pixels. In this manner, the digital signal processing of an image signal can be effected, whereby an observer can observe the image signal as an image with resolution which is apparently improved, as described above in connection with the aforesaid mode for carrying out the present invention as well as the aforesaid embodiments of the same. In this driving method, the sampling of the analog image signal during the A/D conversion may also be performed with a modulated clock signal.

[Embodiment 3]

An example of manufacturing method for the active matrix type semiconductor display devise explained in the Embodiment 1 is described in the present embodiment. A detailed description in accordance with the processes is made here regarding simultaneously fabricating: pixel TFTs which is a switching element at a pixel section; and TFTs for driver circuits disposed in the periphery of the pixel section (a source signal side driver circuit, a gate signal side driver circuit) over a substrate. Note that for the simplicity of the explanation, a CMOS circuit which is a base circuit for a driver circuit portion is shown in the Figure for the driver circuit, and an n-channel TFT for the pixel TFT portion is shown.

Figures 14A, 14B, 14C, 14D:
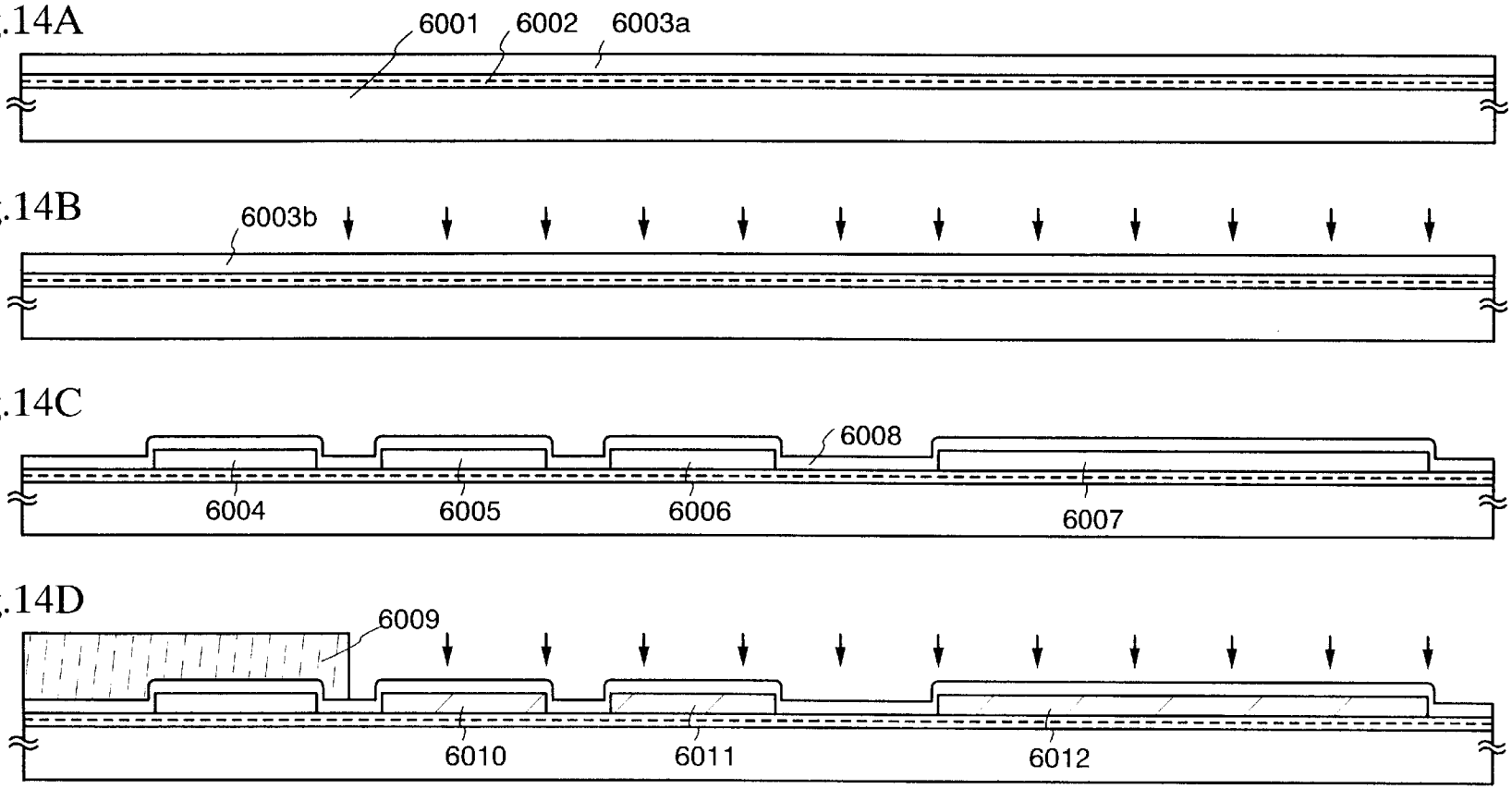
FIGS. 14A to 14D are diagrams showing a process of manufacturing an active matrix semiconductor display device in accordance with Embodiment 2.

In FIG. 14A, a low alkali glass substrate or a quartz substrate can be used as the substrate (an active matrix substrate) 6001. In this embodiment, a low alkali glass substrate was used. In this case, heat treatment may be performed beforehand at a temperature about 10–20° C. lower than the glass strain temperature. On the surface of the substrate 6001 on which the TFTs are formed, there is formed an underlayer film 6002 from such as a silicon oxide film, a silicon nitride film or a silicon oxynitride film, in order to prevent diffusion of the impurity from the substrate 6001. For example, a lamination layer is formed from a silicon oxynitride film from $SiH_4$, $NH_3$ and $N_2O$ to a thickness of 100 nm by plasma CVD, and a silicon oxynitride film similarly from $SiH_4$ and $N_2O$ to a thickness of 200 nm.

Next, a semiconductor film 6003*a* having an amorphous structure is formed into a thickness of 20 to 150 nm (preferably 30 to 80 nm) by a publicly known method such as plasma CVD or sputtering. In this embodiment, an amorphous silicon film was formed to a thickness of 54 nm by plasma CVD. Semiconductor films having amorphous structures include amorphous semiconductor films and micro crystalline semiconductor films, and a compound semiconductor film with an amorphous structure, such as an amorphous silicon-germanium film, may also be used. Since the underlayer film 6002 and the amorphous silicon film 6003*a* can be formed by the same film deposition method, they may be formed in succession. The surface contamination can be prevented by not exposing to the aerial atmosphere after forming the underlayer film, and the scattering of the characteristics in the formed TFTs and deviation of threshold voltage can be reduced. (FIG. 14A).

A publicly known crystallizing technique is then used to form a crystalline silicon film 6003*b* from the amorphous silicon film 6003*a*. For example, a laser crystallizing or heat crystallizing method (solid phase growth method) may be used, and here a crystalline silicon film 6003*b* was formed by a crystallization method using a catalyst element, according to the technique disclosed in Japanese Patent Application Laid-Open No. Hei 7-130652. Though it depends on the hydrogen content of the amorphous silicon film, heat treatment is preferably performed for about one hour at 400 to 500° C. to reduce the hydrogen content to 5 atom % or lower prior to crystallization. Crystallization of the amorphous silicon film causes rearrangement of the atoms to a more dense form, so that the thickness of the crystalline silicon film that is fabricated is reduced by approximately 1 to 15% from the thickness of the original amorphous silicon film (54 nm in this embodiment) (FIG. 14B).

The crystalline silicon film 6003*b* is then patterned into island shape to form island semiconductor layers 6004 to 6007. A mask layer 6008 is then formed by a silicon oxide film with a thickness of 50 to 150 nm by plasma CVD or sputtering (FIG. 14C).

A resist mask 6009 is then disposed, and boron (B) is added as a p-type impurity element at a concentration of about $1\times10^{16}$ to $5\times10^{17}$ atoms/cm$^3$ for the purpose of controlling the threshold voltage, over the entire surface of the island semiconductor layers 6004 to 6007 that form the n-channel-type TFT. The addition of boron (B) may be accomplished by an ion doping, or it may be added simultaneously with formation of the amorphous silicon film. While the addition of boron (B) is not necessarily essential here (FIG. 14D). After that, the resist mask 6009 is omitted.

Figures 15A, 15B, 15C, 15D:
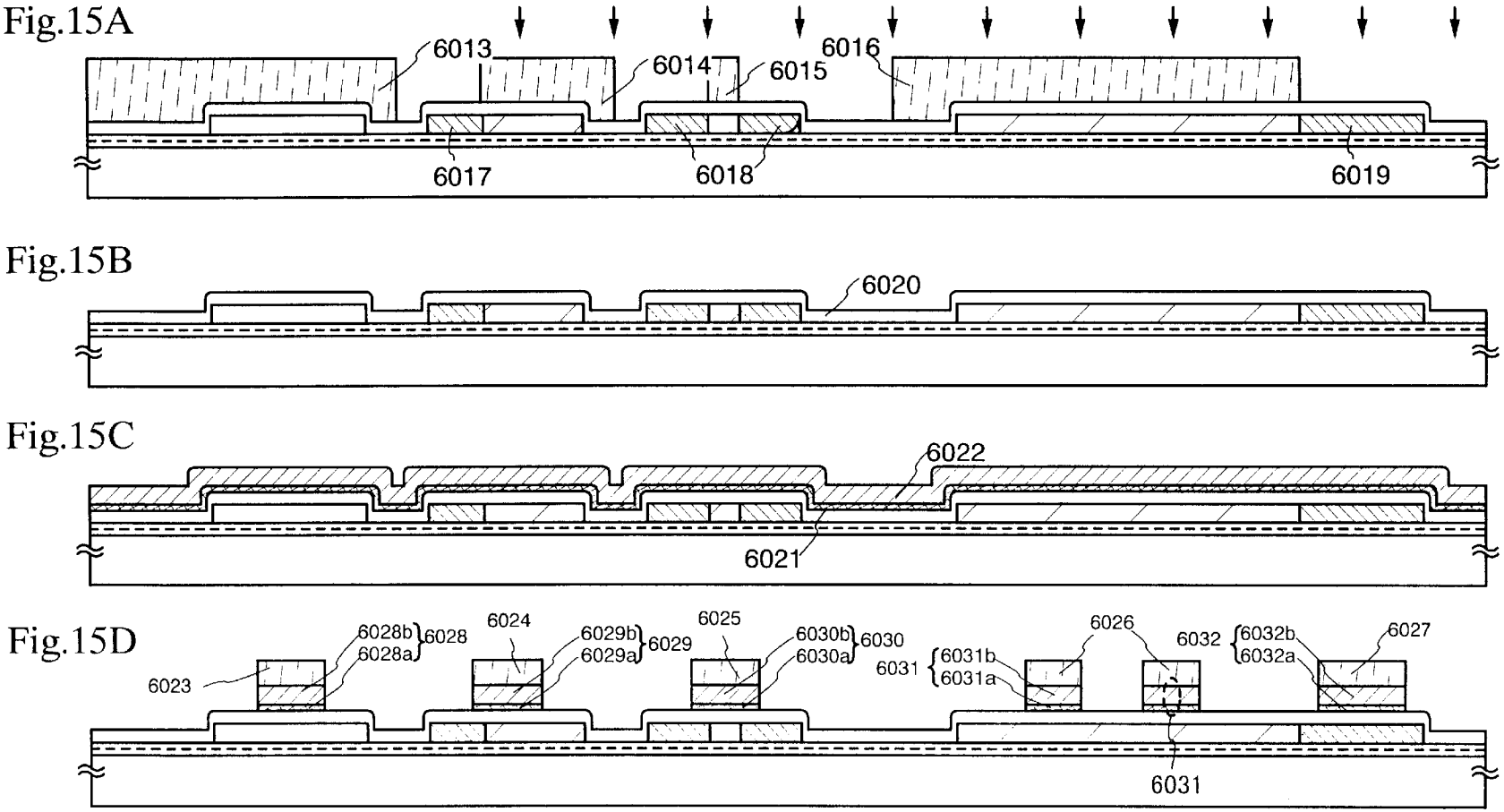
FIGS. 15A to 15D are diagrams showing the process of manufacturing the active matrix semiconductor display device in accordance with Embodiment 2.

An impurity element imparting an n-type is selectively added to the island semiconductor layers 6010 to 6012 in order to form the LDD regions of the n-channel-type TFT of the driving circuit. Resist masks 6013 to 6016 are formed beforehand for this purpose. The n-type impurity element used may be phosphorus (P) or arsenic (As), and in this case, an ion doping method was employed using phosphine ($PH_3$) for addition of phosphorus (P). The phosphorus (P) concentration of the formed impurity regions 6017 and 6018 may be in the range of $2\times10^{16}$ to $5\times10^{19}$ atoms/cm$^3$. Throughout the present specification, the concentration of the n-type impurity element in the impurity regions 6017 to 6019 formed here will be represented as ($n^-$). Further, the impurity region 6019 is a semiconductor layer for formation of the storage capacitor of the pixel portion, and phosphorus (P) was added in the same concentration in this region as well (FIG. 15A). After that, the resist masks 6013 to 6016 are omitted.

This is followed by a step of removing the mask layer 6008 by hydrofluoric acid or the like, and a step of activating the impurity elements added in FIG. 14D and FIG. 15A. The activation may be carried out by heat treatment for 1 to 4 hours at 500 to 600° C. in a nitrogen atmosphere, or by a laser activation method. These may also be carried out in combination. In this embodiment, a laser activation method was used in which a linear beam is formed by using KrF excimer laser light (248 nm wavelengths) and scanned the laser beam at an oscillation frequency of 5 to 50 Hz and an energy density of 100 to 500 mJ/cm$^2$ with 80 to 98% overlap ratio, to treat the entire substrate on which the island semiconductor layers had been formed. There are no particular restrictions on the laser light irradiation conditions, and they may be appropriately set by the operator.

A gate insulating film 6020 is then formed with an insulating film comprising silicon to a thickness of 10 to 150 nm using plasma CVD or sputtering. For example, a silicon oxynitride film is formed to a thickness of 120 nm. The gate insulating film may also be a single layer or multilayer structure of other silicon-containing insulating films (FIG. 15B).

A first conductive layer is then deposited to form the gate electrodes. This first conductive layer may be formed as a single layer, but if necessary it may also have a laminated structure of two or three layers. In this embodiment, a conductive layer (A) 6021 comprising a conductive metal nitride film and a conductive layer (B) 6022 comprising a metal film were laminated. The conductive layer (B) 6022 may be formed of an element selected from among tantalum (Ta), titanium (Ti), molybdenum (Mo) and tungsten (W), or an alloy composed mainly of one of these elements, or an alloy film comprising a combination of these elements (typically a Mo-W alloy film or Mo-Ta alloy film), and the conductive layer (A) 6021 is formed of a tantalum nitride (TaN), tungsten nitride (WN), titanium nitride (TiN) or a molybdenum nitride (MoN). As alternative materials for the conductive layer (A) 6021, there may be used tungsten silicide, titanium silicide or molybdenum silicide. The conductive layer (B) may have a reduced impurity concentration for the purpose of lower resistance, and in particular the oxygen concentration was satisfactory at 30 ppm or lower. For example, tungsten (W) with an oxygen concentration of 30 ppm or lower allowed realization of a resistivity of 20 $\mu\Omega$cm or lower.

The conductive layer (A) 6021 may be 10 to 50 nm (preferably 20 to 30 nm) and the conductive layer (B) 6022 may be 200 to 400 nm (preferably 250 to 350 nm). In this embodiment, a TaN film with a thickness of 30 nm was used as the conductive layer (A) 6021 and a Ta film of 350 nm was used as the conductive layer (B) 6022, and both were formed by sputtering. In this film formation by sputtering, addition of an appropriate amount of Xe or Kr to the Ar sputtering gas can alleviate the internal stress of the formed film to thus prevent peeling of the film. Though not shown, it is effective to form a silicon film doped with phosphorus (P) to a thickness of about 2 to 20 nm under the conductive layer (A) 6021. This can improve adhesion and prevent oxidation of the conductive film formed thereover, while also preventing diffusion of trace alkali metal elements into the gate insulating film 6020 that are contained in the conductive layer (A) or a conductive layer (B) (FIG. 15C).

Resist masks 6023 to 6027 are then formed, and the conductive layer (A) 6021 and conductive layer (B) 6022 are etched together to form gate electrodes 6028 to 6031 and a capacitance wiring 6032. The gate electrodes 6028 to 6031 and capacitance wiring 6032 are integrally formed from 6028*a* to 6032*a* comprising conductive layer (A) and 6028*b* to 6032*b* comprising conductive layer (B). Here, the gate electrodes 6028 and 6030 formed in the driving circuit are formed so as to overlap with a portion of the impurity regions 6017 and 6018 by interposing the gate insulating layer 6020 (FIG. 15D).

Figures 16A, 16B, 16C, 16D:
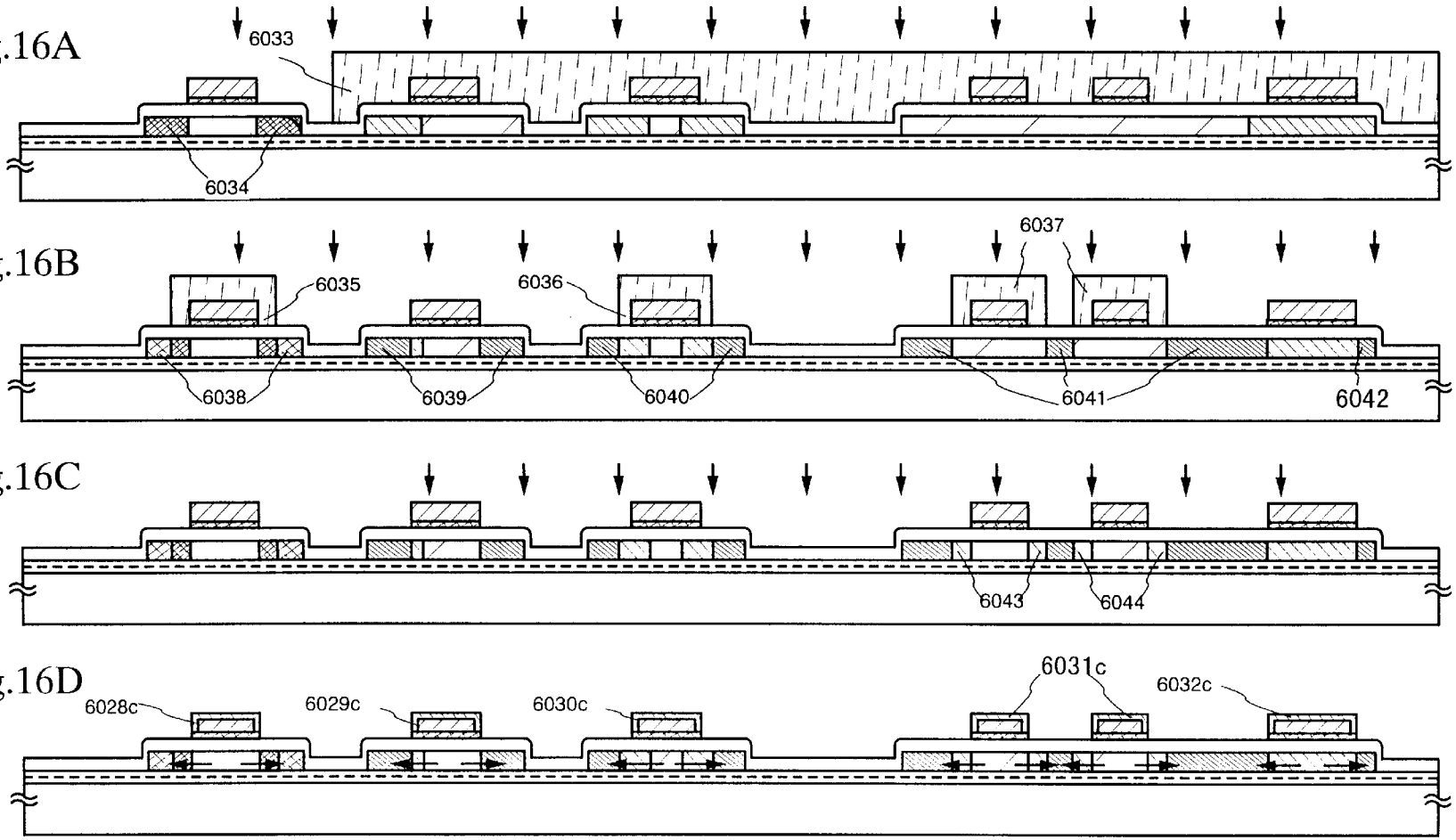
FIGS. 16A to 16D are diagrams showing the process of manufacturing the active matrix semiconductor display device in accordance with Embodiment 2.

This is followed by a step of adding a p-type impurity element to form the source region and drain region in the p-channel TFTs of the driving circuit. Here, the gate electrode 6028 is used as a mask to form impurity regions in a self-alignment manner. The region in which n-channel TFTs are formed is covered at this time with a resist mask 6033. The impurity region 6034 is formed by ion doping using diborane ($B_2H_6$). The boron (B) concentration of this region is $3\times10^{20}$ to $3\times10^{21}$ atoms/cm$^3$. Throughout this specification, the concentration of the p-type impurity element in the impurity region 6034 formed here will be represented as ($p^{++}$) (FIG. 16A).

Next, impurity regions functioning as a source region or a drain region were formed in the n-channel TFT. Resist masks 6035 to 6037 were formed, and an n-type impurity element was added to form impurity regions 6038 to 6042. This was accomplished by ion doping using phosphine ($PH_3$), and the phosphorus (P) concentration in the regions was in the range of $\mathbf{1\times10^{20}}$ to $1\times10^{21}$ atoms/cm$^3$. Throughout the present specification, the concentration of the n-type impurity element in the impurity regions 6038 to 6042 formed here will be represented as ($n^+$) (FIG. 16B).

The impurity regions 6038 to 6042 already contain phosphorus (P) or boron (B) added in the previous step, but since a sufficiently high concentration of phosphorus (P) is added in comparison, the influence of the phosphorus (P) or boron (B) added in the previous step may be ignored. Because the concentration of phosphorus (P) added to the impurity region 6038 is ½ to ⅓ of the boron (B) concentration added in FIG. 16A, the p-type conductivity is guaranteed so that there is no effect on the properties of the TFT.

After the resist masks 6035 to 6037 are eliminated, this is following by a step of adding an n-type impurity to form an LDD region in the n-channel type TFT of the pixel matrix circuit. Here, the gate electrode 6031 is used as a mask for addition of an n-type impurity element in a self-aligning manner by ion doping. The concentration of phosphorus (P) added is $1\times10^{16}$ to $5\times10^{18}$ atoms/cm$^3$, and addition of a lower concentration than the concentrations of the impurity elements added in FIGS. 15A, 16A and 16B substantially form only impurity regions 6043 and 6044. Throughout this specification, the concentration of the n-type impurity element in these impurity regions 6043 and 6044 will be represented as ($n^{--}$) (FIG. 16C).

This was followed by a step of heat treatment for activation of the n-type or p-type impurity element added at their respective concentrations. This step can be accomplished by furnace annealing, laser annealing or rapid thermal annealing (RTA). Here, the activation step was accomplished by furnace annealing. The heat treatment is carried out in a nitrogen atmosphere containing oxygen at a concentration no greater than 1 ppm, preferably no greater than 0.1 ppm, at 400 to 800° C., typically 500 to 600° C., and for this embodiment the heat treatment was carried out at 500° C. for 4 hours. When a heat resistant material such as a quartz substrate is used for the substrate 6001, the heat treatment may be at 800° C. for one hour, and this allowed activation of the impurity element and formation of a satisfactory junction between an impurity region added with an impurity element and a channel forming region. In the case that an interlayer film is formed to protect above mentioned electrode's Ta from peeling, this effect can not always be attained.

In the heat treatment, conductive layers (C) 6028*c* to 6032*c* are formed to a thickness of 5 to 80 nm from the surfaces of the metal films 6028*b* to 6032*b* which comprise the gate electrodes 6028 to 6031 and the capacitance wiring 6032. For example, when the conductive layers (B) 6028*b* to 6032*b* comprise tungsten (W), tungsten nitride (WN) is formed, whereas when tantalum (Ta) is used, tantalum nitride (TaN) can be formed. The conductive layers (C) 6028*c* to 6032*c* may be formed in the same manner by exposing the gate electrodes 6028 to 6031 and the capacitance wiring 6032 to a plasma atmosphere containing nitrogen, using either nitrogen or ammonia. Further a process for hydrogenation was also performed on the island semiconductor layers by heat treatment at 300 to 450° C. for 1 to 12 hours in an atmosphere containing 3 to 100% hydrogen. This step is for terminating the dangling bond of the semiconductor layer by thermally excited hydrogen. Plasma hydrogenation (using plasma-excited hydrogen) may also be carried out as another means for hydrogenation.

When the island semiconductor layer was fabricated by a method of crystallization from an amorphous silicon film using a catalyst element, a trace amount of the catalyst element remained in the island semiconductor layers. While the TFT can be completed even in this condition, needless to say, it is more preferable for the residual catalyst element to be eliminated at least from the channel forming region. One means used to eliminate the catalyst element was utilizing the gettering effect by phosphorus (P). The phosphorus (P) concentration necessary for gettering is on the same level as the impurity region ($n^+$) formed in FIG. 16B, and the heat treatment for the activation step carried out here allowed gettering of the catalyst element from the channel forming region of the n-channel-type TFT and p-channel-type TFT (FIG. 16D).

Figures 17A, 17B, 17C:
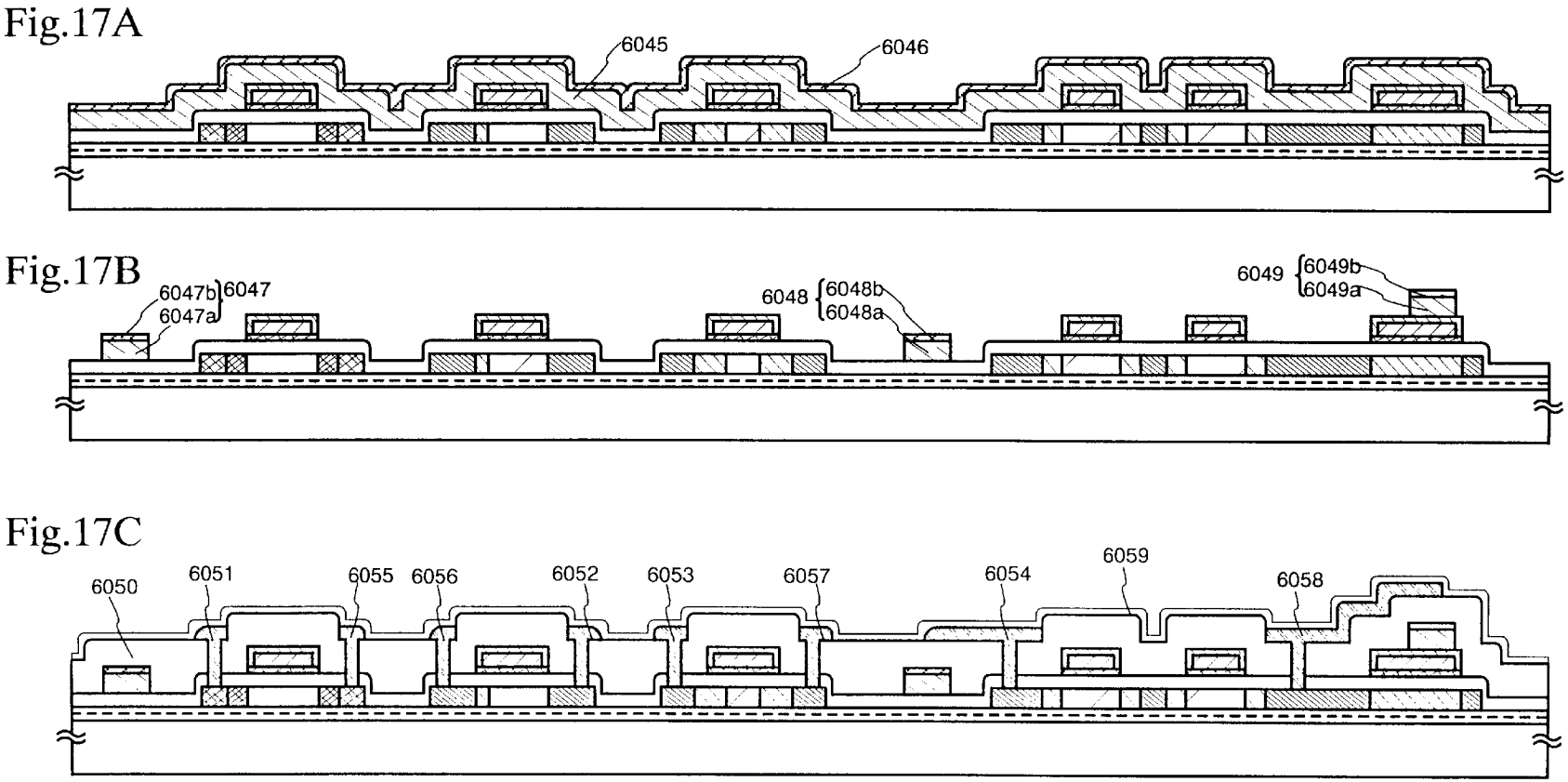
FIGS. 17A to 17C are diagrams showing the process of manufacturing the active matrix semiconductor display device in accordance with Embodiment 2.

After completion of the steps of activation and hydrogenation, the second conductive layer which becomes the gate wiring is formed. This second conductive layer may be formed with a conductive layer (D) composed mainly of aluminum (Al) or copper (Cu) as low resistance materials, and a conductive layer (E) made of titanium (Ti), tantalum (Ta), tungsten (W) or molybdenum (W). In this embodiment, the conductive layer (D) 6045 was formed from an aluminum (Al) film containing 0.1 to 2 wt % titanium (Ti), and the conductive layer (E) 6046 was formed from a titanium (Ti) film. The conductive layer (D) 6045 may be formed to 200 to 400 nm (preferably 250 to 350 nm), and the conductive layer (E) 6046 may be formed to 50 to 200 nm (preferably 100 to 150 nm) (FIG. 17A).

The conductive layer (E) 6046 and conductive layer (D) 6045 were etched to form gate wirings 6047, 6048 and a capacitance wiring 6049 for forming the gate wiring connecting the gate electrodes. In the etching treatment, first removed from the surface of the conductive layer (E) to partway through the conductive layer (D) by dry etching using a mixed gas of $SiCl_4$, $Cl_2$ and $BCl_3$, and then wet etching was performed with a phosphoric acid-based etching solution to remove the conductive layer (D), thus allowing formation of a gate wiring while maintaining selective working with the ground layer.

A first interlayer insulating film 6050 is formed with a silicon oxide film or silicon oxynitride film to a thickness of 500 to 1500 nm, and then contact holes are formed reaching to the source region or drain region formed in each island semiconductor layer, to form source wirings 6051 to 6054 and drain wirings 6055 to 6058. While not shown here, in this embodiment, the electrode has a 3-layer laminated structure with continuous formation of a Ti film to 100 nm, a Ti-containing aluminum film to 300 nm and a Ti film to 150 nm by sputtering.

Next, a silicon nitride film, silicon oxide film or a silicon oxynitride film is formed to a thickness of 50 to 500 nm (typically 100 to 300 nm) as a passivation film 6059. Hydrogenation treatment in this state gave favorable results for enhancement of the TFT characteristics. For example, heat treatment may be carried out for 1 to 12 hours at 300 to 450° C. in an atmosphere containing 3 to 100% hydrogen, or a similar effect may be achieved by using a plasma hydrogenation method. Note that an opening may be formed in the passivation film 6059 here at the position where the contact holes are to be formed for connection of the pixel electrodes and the drain wirings (FIG. 17C).

Figure 18:
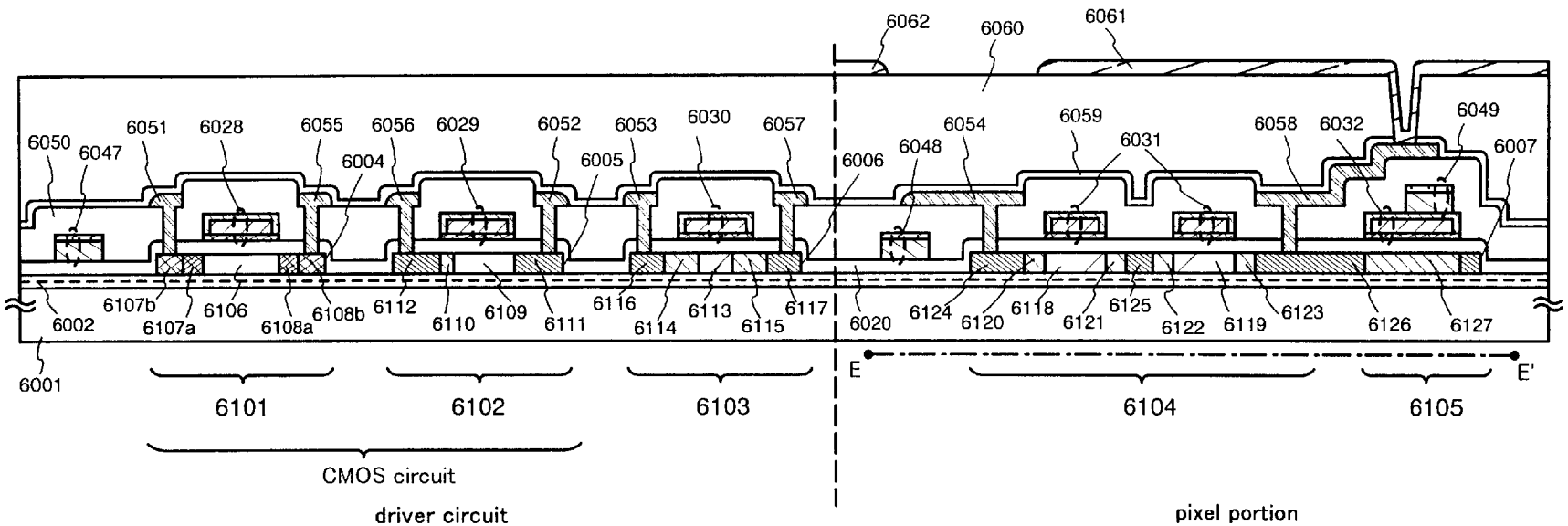
FIG. 18 is a diagram showing the process of manufacturing the active matrix semiconductor display device in accordance with Embodiment 2.

Thereafter, a second interlayer insulating film 6060 comprising an organic resin is formed to a thickness of 1.0 to 1.5 μm. The organic resin used may be polyimide, acrylic, polyamide, poly imide amide, BCB (benzocyclobutene) or the like. Here, a polyimide which thermally polymerizes after coating over the substrate is applied and fired at 300° C. A contact hole reaching to the drain wiring 6058 is then formed in the second interlayer insulating film 6060, and pixel electrodes 6061 and 6062 are formed. The pixel electrodes used may be of a transparent conductive film in the case of forming a transmission type semiconductor display device, or of a metal film in the case of forming a reflective type semiconductor display device. In this embodiment an indium-tin oxide (ITO) film was formed by sputtering to a thickness of 100 nm in order to form a transmission type semiconductor display device (FIG. 18).

A substrate comprising a driving circuit TFT and a pixel TFT of the pixel section was completed over a substrate in this manner. A p-channel TFT 6101, a first n-channel TFT 6102 and a second n-channel TFT 6103 were formed on the driving circuit and a pixel TFT 6104 and a storage capacitor 6105 were formed on the pixel section Throughout the present specification, this substrate will be referred to as an active matrix substrate for the simplicity of explanation.

The p-channel TFT 6101 of the driving circuit comprises an island semiconductor layer 6004 which comprises a channel forming region 6106, source regions 6107*a* and 6107*b*, and drain regions 6108*a* and 6108*b*. The first n-channel TFT 6102 comprises an island semiconductor layer 6005 which comprises a channel forming region 6109, an LDD region 6110 overlapping the gate electrode 6029 (hereinafter this type of LDD region will be referred to as Lov), a source region 6111 and a drain region 6112. The length of this Lov region in the channel length direction was 0.5 to 3.0 μm, and is preferably 1.0 to 1.5 μm. The second n-channel TFT 6103 comprises an island semiconductor layer 6006 which comprises a channel forming region 6113, LDD regions 6114 and 6115, a source region 6116 and a drain region 6117. These LDD regions are formed of an Lov region and an LDD region not overlapping the gate electrode 6030 (hereinafter this type of LDD region will be referred to as Loff), and the length of this Loff region in the channel length direction is 0.3 to 2.0 μm, and preferably 0.5 to 1.5 μm. The pixel TFT 6104 comprises an island semiconductor layer 6007 which comprises a channel forming regions 6118 and 6119, Loff regions 6120 to 6123 and source or drain regions 6124 to 6126. The length of the Loff regions in the channel length direction is 0.5 to 3.0 μm, and preferably 1.5 to 2.5 μm. Further, a storage capacitor 6105 is formed from:

capacitance wirings 6032 and 6049; an insulating film formed from the same material as a gate insulating film; and a semiconductor layer 6127 added with an impurity element imparting n-type which is connected to drain region 6126 of the pixel TFT 6104. In FIG. 28 the pixel TFT 6104 has a double gate structure, but it may also have a single gate structure, and there is no problem with a multi-gate structure provided with multiple gate electrodes.

Thus, the present invention optimizes the structures of the TFTs which comprise each circuit in accordance with the specifications required for the pixel TFT and driving circuit, thereby enabling the operating performance and reliability of the semiconductor device to be improved. In addition, formation of the gate electrodes with a heat resistant conductive material enabled to facilitate activation of the LDD regions and source and drain regions, and formation of the gate wirings with low resistance materials adequately reduce wiring resistance. This allows application to display devices having a pixel section (screen sizes) in the class of 4 inches and larger.

A process for manufacturing a transmission type liquid crystal display device from the active matrix substrate manufactured in accordance with the above processes is next described.

Figure 19:
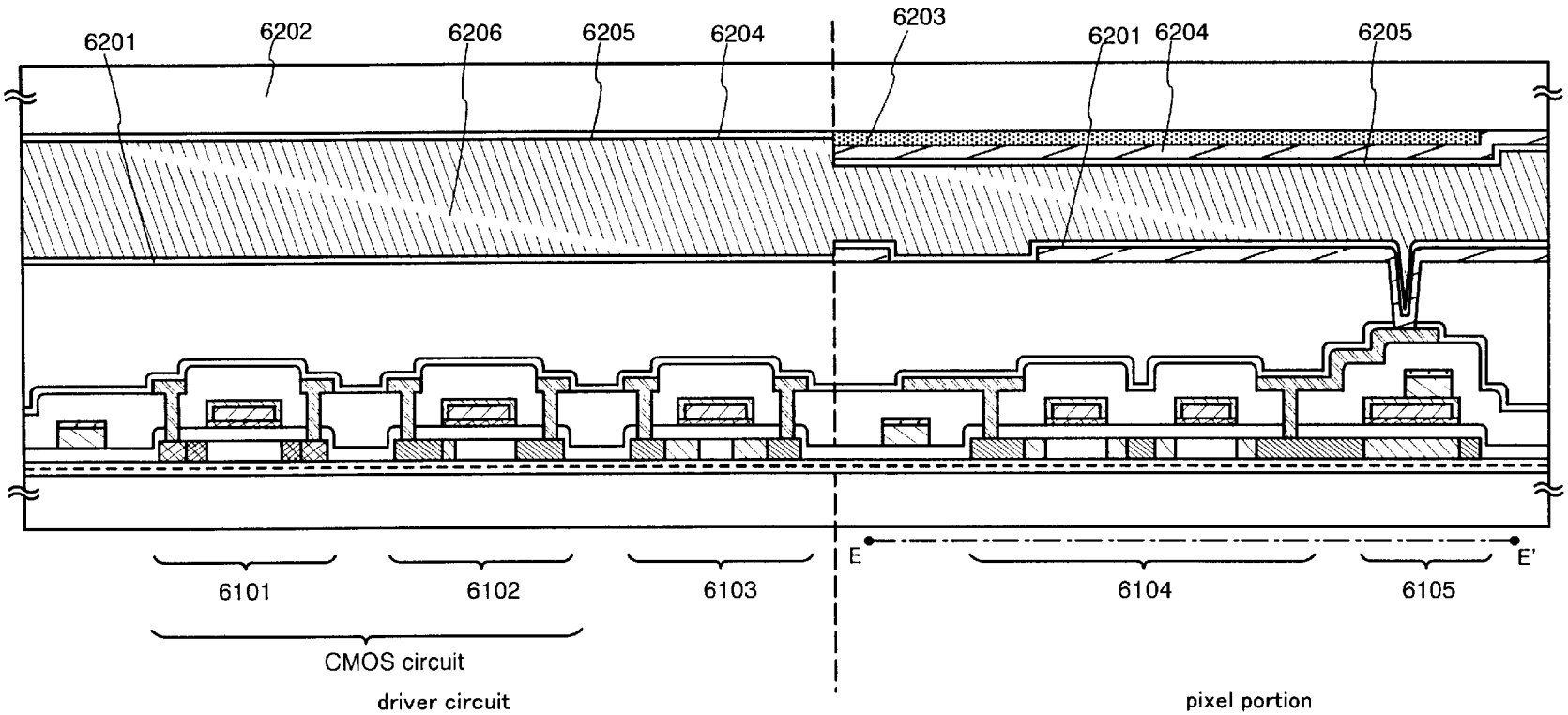
FIG. 19 is a diagram showing the process of manufacturing the active matrix semiconductor display device in accordance with Embodiment 2.

See the FIG. 19. An alignment film 6201 is formed on the active matrix substrate of the state shown in FIG. 18. Polyimide was used in this embodiment as the alignment film 6201. An opposing substrate is next prepared. The opposing substrate comprises a glass substrate 6202, a light shielding film 6203, an opposing electrode 6204 comprising a transparent conductive film and an alignment film 6205.

Note that a polyimide film is used for the alignment film in this embodiment so as to make the liquid crystal molecules orient in parallel with respect to the substrate. The liquid crystal molecules are made to orient in parallel to have a certain pre-tilt angle by performing rubbing treatment after forming the alignment film.

The active matrix substrate which has gone through the above processes and the opposing substrate are next stuck together through a sealant or spacers (neither shown in the figure) by a known cell assembly process. Thereafter, liquid crystal 6206 is injected between the two substrates and completely sealed by a sealant (not shown). A transmission type liquid crystal display device as shown in FIG. 22 is thus complete.

Although the example of forming the active matrix circuit using the top gate TFT is shown in this embodiment, it is enabled that the active matrix circuit can be formed using the bottom gate TFT or another structure TFT.

[Embodiment 4]

In this embodiment, an active matrix type semiconductor display device or a passive matrix type semiconductor display device using the driver circuit of the present invention have various usage. In this embodiment, an active matrix type semiconductor display device or a passive matrix type semiconductor display device (referred to as a semiconductor device) incorporated a semiconductor device is explained.

Mentioned as such semiconductor devices, a portable information terminal (such as an electronic book, mobile computer or mobile telephone), a video camera, a steel camera, personal computer, television, projector devise and so forth. Examples of the electronic equipment are illustrated in FIGS. 20, 21 and 22.

Figure 20A:
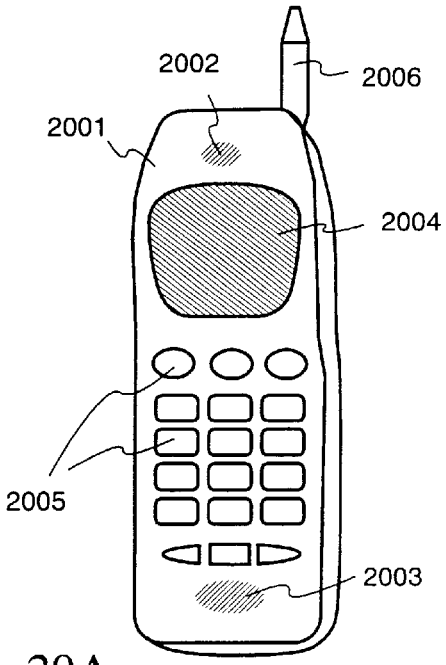
FIGS. 20A to 20F are diagrams showing examples of semiconductor devices incorporating an active matrix semiconductor display device of the present invention.

FIG. 20A shows a mobile phone, which includes the body 2001, a sound output unit 2002, a sound input unit 2003, display device 2004, an operating switch 2005, an antenna 2006. The present invention can be applied to a display portion 2004 equipped an active matrix substrate.

Figure 20B:
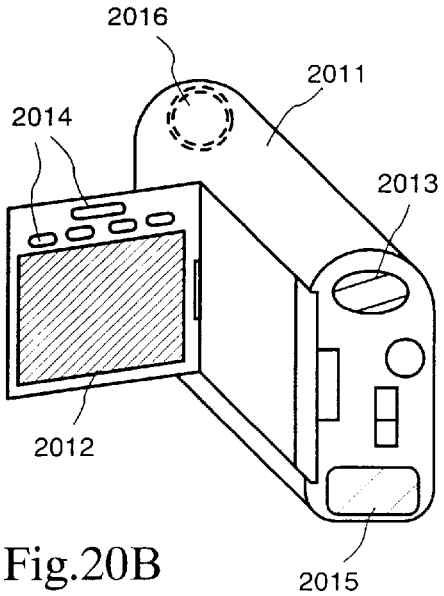

FIG. 20B shows a video camera, which includes the body 2011, a display unit 2012, a sound input unit 2013, operating switches 2014, a battery 2015, and an image receiving unit 2016. The present invention can be applied to a display device 2012 equipped an active matrix substrate.

Figure 20C:
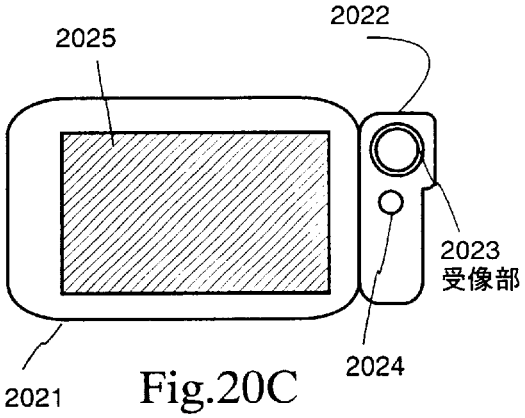

FIG. 20C shows a mobile computer, or a portable information terminal which includes the body 2021, camera unit 2022, an image receiving unit 2023, an operating switch 2024, a display unit 2025. The present invention can be applied to a display portion 2025 equipped an active matrix substrate.

Figure 20D:
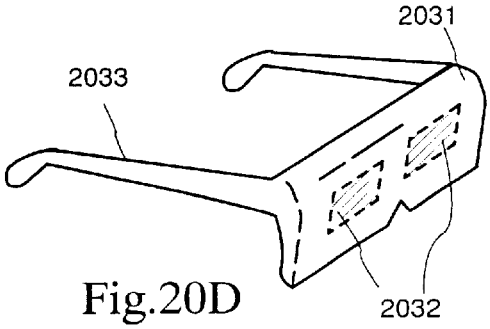

FIG. 20D shows a head mounted display, which includes the body 2031, a display device 2032, arm portion 2033. The present invention can be applied to the display portion 2032 equipped an active matrix substrate.

Figure 20E:
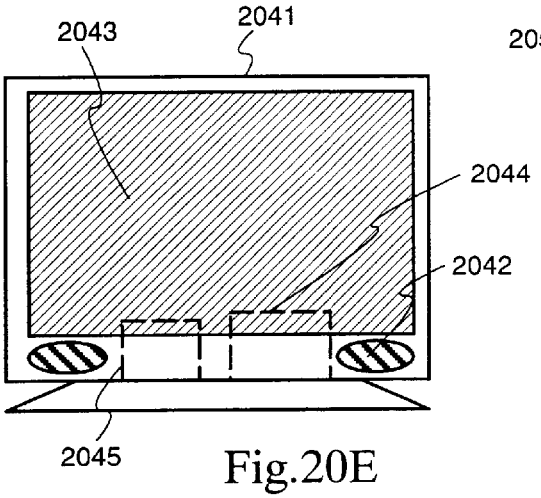

FIG. 20E shows a television, which includes the body 2041, a speaker 2042, display portion 2043, a receiving apparatus 2044, an amplifier 2045 and the like. The present invention can be applied to a display portion 2043 equipped an active matrix substrate.

Figure 20F:
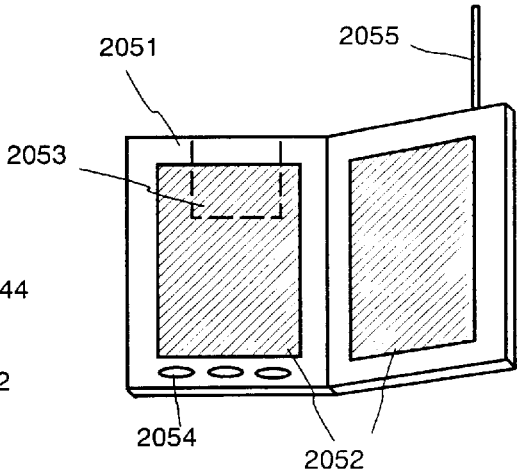

FIG. 20F shows a portable book, which includes the body 2051, display units 2052, 2053, the record medium 2054, an operating switch 2055 and an antenna 2056. This book displays a data recorded in a mini disc (MD) and DVD (Digital Versatile Disc), and a data received by an antenna. The present invention can be applied to a display portion 2052 equipped an active matrix substrate.

Figure 21A:
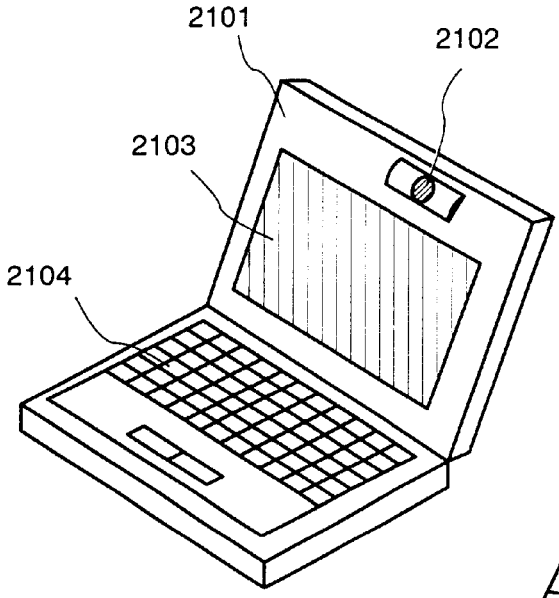
FIGS. 21A to 21D are diagrams showing examples of semiconductor devices incorporating an active matrix semiconductor display device of the present invention.

FIG. 21A shows a personal computer, which includes the body 2101, an image receiving unit 2102, a display device 2103 and a keyboard 2104. The present invention can be applied to a display portion 2103 equipped an active matrix substrate.

Figure 21B:
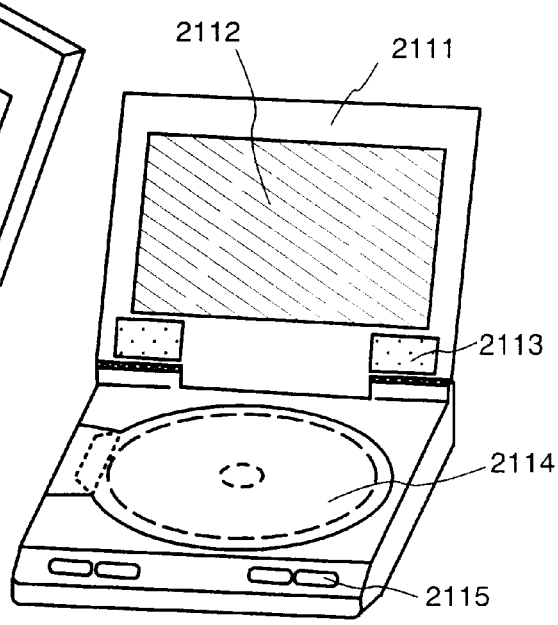

FIG. 21B shows a player using recording medium recorded a program, which includes the body 2111, the display unit 9702, the speaker unit 2113, the record medium 2114, the operating switches 2115. This equipment can be realized music appreciation, movie appreciation, playing game and Internet by using the DVD (Digital Versatile Disc), CD etc. as a recording medium. The present invention can be applied to a display portion 2112 equipped an active matrix substrate.

Figure 21C:
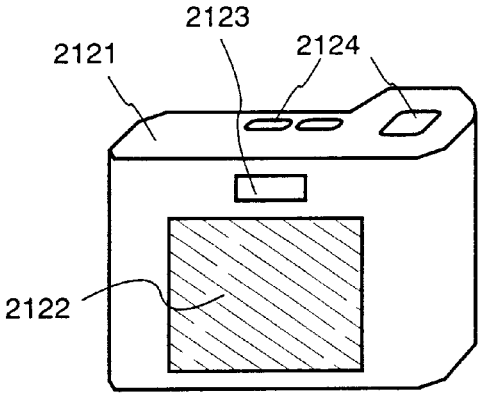

FIG. 21C shows a digital camera, which includes the body 2121, display unit 2122, a view finder 2123, an operating switch 2124 and an image receiving unit (not shown). The present invention can be applied to a display portion 2122 equipped an active matrix substrate.

Figure 21D:
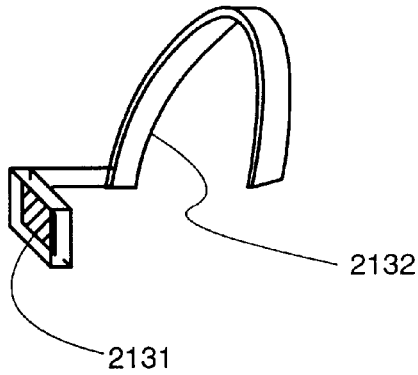

FIG. 21D shows an one-eyed head mounted display, which includes the body 2131, a band portion 2132. The present invention can be applied to the display portion 2131 equipped an active matrix substrate.

Figure 22A:
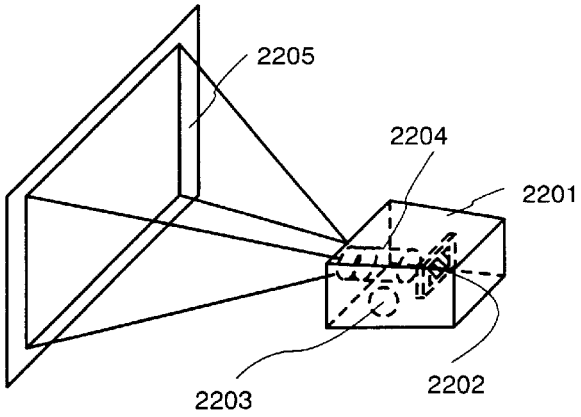
FIGS. 22A to 22D are diagrams showing examples in which an active matrix semiconductor display device of the present invention is incorporated into a front type projector and a rear type projector.

FIG. 22A shows a front type projector, which includes the projection unit 2201, a semiconductor display device 2202, light source's 2203, an optical light system 2204 and a screen 2205. Further, the single plate system can be used to the projector 2201 and the three plate system which is correspond to R, G and B light respectively can also be used. The present invention can be applied to the semiconductor display device 2202 equipped an active matrix substrate.

Figure 22B:
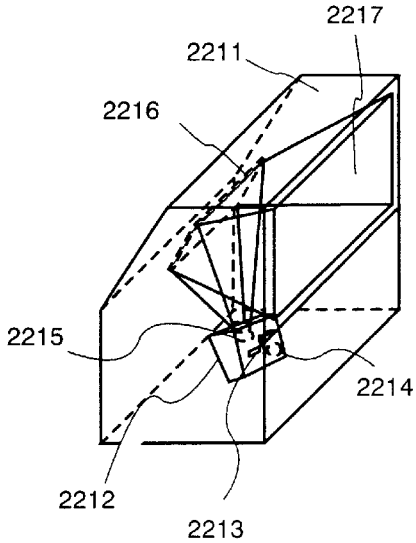

FIG. 22B shows a rear type projector, which includes the main body 2211, the projection unit 2212, a semiconductor display device 2213, light sources 2214, an optical light system 2215, a reflector 2216 and a screen 2217. Further, the single plate system can be used to the projector 2213 and the three plate system which is correspond to R, G and B light respectively can also be used. The present invention can be applied to the semiconductor display device 2213 equipped an active matrix substrate.

Figure 22C:
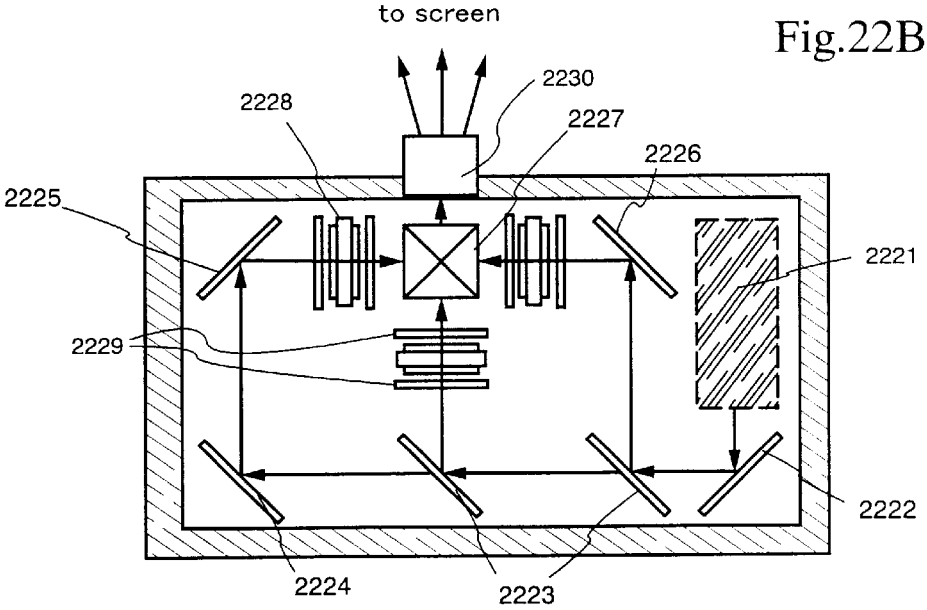

Illustrated in FIG. 22C is an example of the structure of the projection units 2201 and 2212 that are shown in FIGS. 22A and 22B, respectively. Each of the projection units 2201 and 2212 comprise a light source optical system 2221, mirrors 2222 and 2224 to 2226, dichroic mirrors 2223, a prism 2227, liquid crystal display devices 2228, phase difference plates 2229, and a projection optical system 2230. The projection optical system 2230 is constructed of an optical system including projection lenses. An example of a three plate system is shown in this embodiment, but there are no special limitations. For instance, an optical system of single plate system is acceptable. Further, the operator may suitably set optical systems such as optical lenses, polarizing film, film to regulate the phase difference, IR film, within the optical path shown by the arrows in FIG. 22C.

Figure 22D:
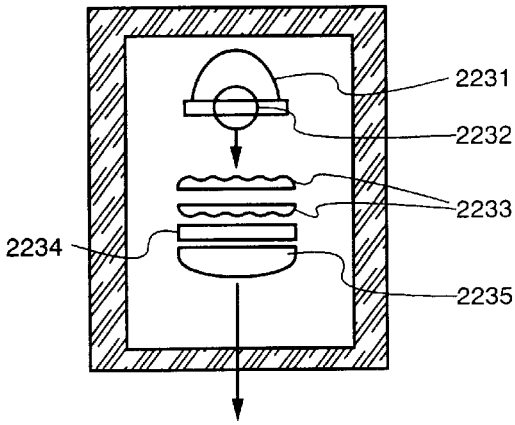

In addition, FIG. 22D shows an example of the structure of the light source optical system 2221 of FIG. 22C. In this embodiment, the light source optical system 2221 is composed of a reflector 2231, a light source 2232, lens arrays 2233, a polarizing conversion element 2234, and a condenser lens 2235. Note that the light source optical system shown in FIG. 22D is an example, and it is not limited to the illustrated structure. For example, the operator may suitably set optical systems such as optical lenses, polarizing film, film to regulate the phase difference, and IR film.

Further the example which is a semiconductor device incorporated an active matrix type semiconductor device is shown in this embodiment, the present invention can be applied to the semiconductor device incorporated a passive matrix type semiconductor display device.

In accordance with the driving method of the present invention, by supplying a modulated clock signal which is frequency modulated at a constant period to a gate driver circuit of an active matrix semiconductor display device or to a scanning electrode of a passive matrix semiconductor display circuit, a scanning signal output based on the modulated clock selects a plurality of scanning lines simultaneously over a portion of a screen, or a whole screen. By essentially reducing the number of vertical scans per frame, a format conversion of a video signal corresponding to low resolution to be displayed in an active matrix semiconductor display device or in a passive matrix semiconductor display device corresponding to high resolution can be completely realized without using peripheral equipment such as memory.

Further, in accordance with the driving method of the present invention, by supplying a modulated clock signal, frequency modulated at a constant period, to a gate side and a source driver circuit of an active matrix semiconductor display device, or to a scanning electrode and a signal electrode of a passive matrix semiconductor display device, signal information of the sampling vicinity of a video signal sampled based upon the modulated clock signal (existence of an edge, closeness) can be written to the corresponding pixels of the semiconductor display device as shading information. According to the driving method of the present invention, the resulting display can be seen as having an increased resolution in accordance with the visual Mach phenomenon and the Craik-O'Brien phenomenon. Therefore, the resolution is essentially increased over an active matrix semiconductor display device and a passive matrix semiconductor display device driven by a conventional method of driving, and a good image can be provided.

What is claimed is:

1. A method of driving a semiconductor display device, comprising the steps of:

performing frequency modulation of a first standard clock signal and obtaining a first modulated clock signal;

selecting a plurality of gate signal lines simultaneously based upon the first modulated clock signal to reduce the number of vertical scans per frame;

sampling an image signal based on a second standard clock signal; and supplying the sampled image signal to a corresponding pixel and obtaining an image.

2. A method of driving a semiconductor display device, comprising the steps of:

performing frequency modulation of a first standard clock signal and obtaining a first modulated clock signal;

performing frequency modulation of a second standard clock signal and obtaining a second modulated clock signal;

selecting a plurality of gate signal lines simultaneously based upon the first modulated clock signal to reduce the number of vertical scans per frame;

sampling an image signal based on the second modulated clock signal; and supplying the sampled image signal to a corresponding pixel and obtaining an image.

3. A method of driving a semiconductor display device, comprising the steps of:

performing frequency modulation of a first standard clock signal and obtaining a first modulated clock signal;

selecting a plurality of gate signal lines simultaneously based upon the first modulated clock signal to reduce the number of vertical scans per frame;

sampling an analog image signal based on a second standard clock signal, performing A/D conversion, and obtaining a digital image signal;

performing D/A conversion based on the second standard clock signal after performing digital signal processing of the digital image signal, and obtaining an improved analog image signal; and supplying the improved analog image signal to a corresponding pixel and obtaining an image.

4. A method of driving a semiconductor display device, comprising the steps of:

performing frequency modulation of a first standard clock signal and obtaining a first modulated clock signal;

performing frequency modulation of a second standard clock signal and obtaining a second modulated clock signal;

selecting a plurality of gate signal lines simultaneously based upon the first modulated clock signal to reduce the number of vertical scans per frame;

sampling an analog image signal based on the second modulated clock signal, performing A/D conversion, and obtaining a digital image signal;

performing D/A conversion based on the second standard clock signal after performing digital signal processing of the digital image signal, and obtaining an improved analog image signal; and supplying the improved analog image signal to a corresponding pixel and obtaining an image.

5. A method of driving a semiconductor display device, comprising the steps of:

performing frequency modulation of a first standard clock signal and obtaining a first modulated clock signal;

performing frequency modulation of a second standard clock signal and obtaining a second modulated clock signal;

selecting a plurality of gate signal lines simultaneously based upon the first modulated clock signal to reduce the number of vertical scans per frame;

sampling an analog image signal based on the second modulated clock signal, performing A/D conversion, and obtaining a digital image signal;

performing D/A conversion based on the second modulated clock signal after performing digital signal processing of the digital image signal, and obtaining an improved analog image signal; and supplying the improved analog image signal to a corresponding pixel and obtaining an image.

6. The method of driving a semiconductor display device according to any one of claims 1 to 5, wherein either the first or the second modulated clock signal may also be obtained by raising or lowering the frequency of either the first or the second standard clock signal at a constant period.

7. The method of driving a semiconductor display device according to any one of claims 1 to 5, wherein either the first or the second modulated clock signal may also be obtained by shifting the frequency of either the first or the second standard clock signal based on a Gaussian histogram.

8. The method of driving a semiconductor display device according to any one of claims 1 to 5, wherein either the first or the second modulated clock signal may also be obtained by randomly shifting the frequency of either the first or the second standard clock signal.

9. The method of driving a semiconductor display device according to any one of claims 1 to 5, wherein either the first or the second modulated clock signal may also be obtained by sinusoidally shifting the frequency of either the first or the second standard clock signal.

10. The method of driving a semiconductor display device according to any one of claims 1 to 5, wherein either the first or the second modulated clock signal may also be obtained by shifting the frequency of either the first or the second standard clock signal by using a triangular wave.

11. A semiconductor display device comprising:

an active matrix circuit having a plurality of transistors arranged in a matrix shape; and a gate signal line driver circuit and a source signal line driver circuit for driving the active matrix circuit; wherein a first modulated clock signal, in which a first standard clock signal is frequency modulated, is input to the gate signal line driver circuit to select a plurality of gate signal lines and reduce the number of vertical scans per frame, and a second standard clock signal is input to the source signal line driver circuit.

12. A semiconductor display device comprising:

an active matrix circuit having a plurality of transistors arranged in a matrix shape; and a gate signal line driver circuit and a source signal line driver circuit for driving the active matrix circuit;

wherein a first modulated clock signal, in which a first standard clock signal is frequency modulated, is input to the gate signal line driver circuit to select a plurality of gate signal lines and reduce the number of vertical scans per frame, and a second modulated clock signal, in which a second standard clock signal is frequency modulated, is input to the source signal line driver circuit.

13. A semiconductor display device comprising a passive matrix circuit, wherein a first modulated clock signal, in which a first standard clock signal is frequency modulated, is input to a plurality of scanning electrodes of the passive matrix circuit; and wherein an image signal sampled based on a second standard clock signal is input to a signal electrode of the passive matrix circuit.

14. A semiconductor display device comprising a passive matrix circuit, wherein a first modulated clock signal, in which a first standard clock signal is frequency modulated, is input to a plurality of scanning electrodes of the passive matrix circuit; and wherein an image signal sampled based on a second modulated clock signal, in which a second standard clock signal is frequency modulated, is input to a signal electrode of the passive matrix circuit.

15. The method of driving a semiconductor display device according to any one of claims 11 to 14, wherein either the first or the second modulated clock signal may also be obtained by raising or lowering the frequency of either the first or the second standard clock signal at a constant period.

16. The method of driving a semiconductor display device according to any one of claims 11 to 14, wherein either the first or the second modulated clock signal may also be obtained by shifting the frequency of either the first or the second standard clock signal based on a Gaussian histogram.

17. The method of driving a semiconductor display device according to any one of claims 11 to 14, wherein either the first or the second modulated clock signal may also be obtained by randomly shifting the frequency of either the first or the second standard clock signal.

18. The method of driving a semiconductor display device according to any one of claims 11 to 14, wherein either the first or the second modulated clock signal may also be obtained by sinusoidally shifting the frequency of either the first or the second standard clock signal.

19. The method of driving a semiconductor display device according to any one of claims 11 to 14, wherein either the first or the second modulated clock signal may also be obtained by shifting the frequency of either the first or the second standard clock signal by using a triangular wave.

20. A method for displaying an image in an active matrix semiconductor display device corresponding to a high resolution using a video signal corresponding to a low resolution, comprising the steps of:

performing frequency modulation of a first standard clock signal and obtaining a first modulated clock signal;

selecting a plurality of gate signal lines simultaneously based upon the first modulated clock signal;

sampling the video signal based on a second standard clock signal; and supplying the sampled image signal to a corresponding pixel and obtaining the image.

21. A method for displaying an image in an active matrix semiconductor display device corresponding to a high resolution using a video signal corresponding to a low resolution, comprising the steps of:

performing frequency modulation of a first standard clock signal and obtaining a first modulated clock signal;

performing frequency modulation of a second standard clock signal and obtaining a second modulated clock signal;

selecting a plurality of gate signal lines simultaneously based upon the first modulated clock signal;

sampling the video signal based on the second modulated clock signal; and supplying the sampled image signal to a corresponding pixel and obtaining the image.

22. A method for displaying an image in an active matrix semiconductor display device corresponding to a high resolution using an analog image signal corresponding to a low resolution, comprising the steps of:

performing frequency modulation of a first standard clock signal and obtaining a first modulated clock signal;

selecting a plurality of gate signal lines simultaneously based upon the first modulated clock signal to reduce the number of vertical scans per frame;

sampling the analog image signal based on a second standard clock signal, performing A/D conversion, and obtaining a digital image signal;

performing D/A conversion based on the second standard clock signal after performing digital signal processing of the digital image signal, and obtaining an improved analog image signal; and supplying the improved analog image signal to a corresponding pixel and obtaining the image.

23. A method for displaying an image in an active matrix semiconductor display device corresponding to a high resolution using an analog image signal corresponding to a low resolution, comprising the steps of:

performing frequency modulation of a first standard clock signal and obtaining a first modulated clock signal;

performing frequency modulation of a second standard clock signal and obtaining a second modulated clock signal;

selecting a plurality of gate signal lines simultaneously based upon the first modulated clock signal to reduce the number of vertical scans per frame;

sampling the analog image signal based on the second modulated clock signal, performing A/D conversion, and obtaining a digital image signal;

performing D/A conversion based on the second standard clock signal after performing digital signal processing of the digital image signal, and obtaining an improved analog image signal; and supplying the improved analog image signal to a corresponding pixel and obtaining the image.

24. A method for displaying an image in an active matrix semiconductor display device corresponding to a high resolution using an analog image signal corresponding to a low resolution, comprising the steps of:

performing frequency modulation of a first standard clock signal and obtaining a first modulated clock signal;

performing frequency modulation of a second standard clock signal and obtaining a second modulated clock signal;

selecting a plurality of gate signal lines simultaneously based upon the first modulated clock signal to reduce the number of vertical scans per frame;

sampling the analog image signal based on the second modulated clock signal, performing A/D conversion, and obtaining a digital image signal;

performing D/A conversion based on the second modulated clock signal after performing digital signal processing of the digital image signal, and obtaining an improved analog image signal; and supplying the improved analog image signal to a corresponding pixel and obtaining the image.

25. A method for displaying an image in an active matrix semiconductor display device corresponding to a high resolution using an analog image signal corresponding to a low resolution, comprising the steps of:

performing frequency modulation of a first standard clock signal and obtaining a first modulated clock signal;

performing frequency modulation of a second standard clock signal and obtaining a second modulated clock signal;

selecting a plurality of gate signal lines simultaneously based upon the first modulated clock signal to reduce the number of vertical scans per frame;

sampling the analog image signal based on the second modulated clock signal, performing A/D conversion, and obtaining a digital image signal;

performing D/A conversion based on the second modulated clock signal after performing digital signal processing of the digital image signal, and obtaining an improved analog image signal; and supplying the improved analog image signal to a corresponding pixel and obtaining an image.

* * * * *